US009090107B2

(12) United States Patent
Iijima

(10) Patent No.: US 9,090,107 B2
(45) Date of Patent: Jul. 28, 2015

(54) IMAGE RECORDING APPARATUS

(71) Applicant: BROTHER KOGYO KABUSHIKI KAISHA, Nagoya-shi, Aichi-ken (JP)

(72) Inventor: Shota Iijima, Nagoya (JP)

(73) Assignee: BROTHER KOGYO KABUSHIKI KAISHA, Nagoya, Aichi-Ken (JP)

( * ) Notice: Subject to any disclaimer, the term of this patent is extended or adjusted under 35 U.S.C. 154(b) by 148 days.

(21) Appl. No.: 14/011,829

(22) Filed: Aug. 28, 2013

(65) Prior Publication Data

US 2014/0063162 A1 Mar. 6, 2014

(30) Foreign Application Priority Data

Aug. 31, 2012 (JP) ..... 2012-192626

(51) Int. Cl.
*B41J 13/00* (2006.01)
*B41J 3/60* (2006.01)

(52) U.S. Cl.
CPC *B41J 13/009* (2013.01); *B41J 3/60* (2013.01); *B41J 13/0009* (2013.01); *B41J 13/0045* (2013.01)

(58) Field of Classification Search
USPC ..... 347/104, 171, 172, 174, 176, 218, 16; 400/82, 188
See application file for complete search history.

(56) References Cited

U.S. PATENT DOCUMENTS

| | | | | |
|---|---|---|---|---|
| 5,689,793 | A | 11/1997 | Kobayashi et al. | |
| 5,819,152 | A | 10/1998 | Kobayashi et al. | |
| 8,696,109 | B2 * | 4/2014 | Ito et al. | 347/104 |
| 8,870,476 | B2 * | 10/2014 | Horade | 400/76 |
| 2014/0063108 | A1 * | 3/2014 | Iijima | 347/16 |

FOREIGN PATENT DOCUMENTS

| | | | |
|---|---|---|---|
| JP | H07-033279 | A | 2/1995 |
| JP | H08-133551 | A | 5/1996 |
| JP | 2001-225995 | A | 8/2001 |
| JP | 2006-008267 | A | 1/2006 |
| JP | 2007-136802 | A | 6/2007 |

* cited by examiner

*Primary Examiner* — Huan Tran
(74) *Attorney, Agent, or Firm* — Merchant & Gould PC

(57) ABSTRACT

An image recording apparatus includes: a conveyor roller pair for conveying a sheet along a first path in a conveying direction; a reversible roller pair including first and second rollers and for conveying the sheet in the conveying direction and to a second path; a state switching mechanism for switching the reversible roller pair between a first state in which the first roller is pressed against the second roller and a second state in which the first roller is distant from or pressed against the second roller with smaller force; and a controller for controlling: the reversible roller pair to convey the sheet along the second path until its leading edge reaches a position downstream of the conveyor roller pair and upstream of the reversible roller pair; the reversible roller pair to switch from the first state to the second state; and a recorder to perform image recording.

21 Claims, 14 Drawing Sheets

IMAGE RECORDING APPARATUS

CROSS REFERENCE TO RELATED APPLICATION

The present application claims priority from Japanese Patent Application No. 2012-192626, which was filed on Aug. 31, 2012, the disclosure of which is herein incorporated by reference in its entirety.

BACKGROUND OF THE INVENTION

1. Field of the Invention

The present invention relates to an image recording apparatus configured to record an image on a sheet, and more particularly to an image recording apparatus capable of recording images on both surfaces of a sheet.

2. Description of the Related Art

In recent years, an image recording apparatus of a smaller size is required. An image recording apparatus, on the other hand, is required to record images on both surfaces of a sheet having the largest possible size. In an image recording apparatus satisfying these two requirements, a sheet is conveyed by a conveyor roller pair to a position under a recording unit where the recording unit records an image on a front surface of the sheet, and thereafter the sheet printed on its front surface is conveyed by a reversible roller pair to a re-supply conveyance path, then conveyed to the conveyor roller pair again, and printed on a back surface of the sheet. If a sheet has a relatively large size, when a leading edge of the sheet printed on its front surface is conveyed back to the reversible roller pair, a trailing edge portion of the sheet may have not come out of the reversible roller pair and may be still nipped by the reversible roller pair.

There is known the following conventional technique for solving this problem: in a case where the sheet has a size larger than a predetermined size, a pair of rollers of the reversible roller pair are moved off each other before the leading edge of the sheet returns to the reversible roller pair, allowing the leading edge of the sheet to pass through the reversible roller pair.

SUMMARY OF THE INVENTION

However, when the pair of rollers of the reversible roller pair nipping the sheet therebetween are moved off each other, a pressure applied to the sheet from the reversible roller pair disappears, which may move the sheet in a conveying direction. If the pair of rollers of the reversible roller pair nipping the sheet therebetween are moved off each other during image recording for the sheet, movement of the sheet in the conveying direction may adversely affect quality of image recorded on the sheet.

This invention has been developed to provide an image recording apparatus including a reversible roller pair having a pair of rollers for conveying a sheet to a re-supply conveyance path and capable of reducing a pressing force of the pair of rollers or moving the pair of rollers off each other while preventing deterioration of image quality.

The present invention provides an image recording apparatus, including: a first conveyor roller pair provided in a first conveyance path and configured to convey a sheet in a conveying direction; a recording device provided downstream of the first conveyor roller pair in the conveying direction and configured to record an image on the sheet; a reversible roller pair provided downstream of the first conveyor roller pair in the conveying direction and including a first roller and a second roller, the reversible roller pair being configured to convey the sheet in the conveying direction and configured to convey the sheet to a second conveyance path that is connected to the first conveyance path at (i) a position located downstream of the first conveyor roller pair in the conveying direction and upstream of the reversible roller pair in the conveying direction and (ii) a position located upstream of the first conveyor roller pair in the conveying direction; a state switching mechanism configured to switch a state of the reversible roller pair between (a) a first state in which the first roller is pressed against the second roller and (b) a second state that is one of a state in which a force for pressing the first roller against the second roller is less than a force for pressing the first roller against the second roller in the first state and a state in which the first roller is spaced apart from the second roller; and a controller configured to control the reversible roller pair to convey the sheet along the second conveyance path until a leading edge of the sheet reaches a position located downstream of the first conveyor roller pair in the conveying direction and upstream of the reversible roller pair in the conveying direction in the first conveyance path, thereafter control the state switching mechanism to switch the state of the reversible roller pair from the first state to the second state, and thereafter control the recording device to perform image recording on the sheet.

In the image recording apparatus configured as described above, the reversible roller pair is switched from the first state to the second state before the image recording is started for the sheet. This operation can prevent deterioration of image quality on the sheet, which deterioration is caused by the state switch of the reversible roller pair from the first state to the second state during image recording.

Also, the reversible roller pair is switched from the first state to the second state in the state in which the leading edge of the sheet conveyed is located downstream of the first conveyor roller pair in the conveying direction, in other words, in the state in which the sheet is nipped by the first conveyor roller pair. In this state, the sheet is nipped by the first conveyor roller pair between a nipping position of the reversible roller pair and the leading edge of the sheet. Thus, even if the state of the reversible roller pair is switched in the state in which the sheet is nipped by both of the reversible roller pair and the first conveyor roller pair, and thereby a force for moving the sheet toward its leading edge is applied to the sheet conveyed from the nipping position of the reversible roller pair, transfer of the force is hindered at the nipping position of the first conveyor roller pair. This makes it possible to prevent unexpected movement of the sheet due to the state switch of the reversible roller pair.

The image recording apparatus, further includes a second conveyor roller pair disposed in the second conveyance path and configured to convey the sheet toward the first conveyor roller pair.

In the image recording apparatus configured as described above, even if the state of the reversible roller pair is switched, and thereby a force for moving the sheet toward its leading edge is applied to the sheet conveyed from the nipping position of the reversible roller pair, the sheet is nipped by both of the first conveyor roller pair and the second conveyor roller pair. This makes it possible to more reliably prevent unexpected movement of the sheet due to the state switch of the reversible roller pair.

In the image recording apparatus, the reversible roller pair is provided downstream of the recording device in the conveying direction. The second conveyance path is connected to the first conveyance path at (i) a position located downstream of the recording device in the conveying direction and upstream of the reversible roller pair in the conveying direction and (ii) the position located upstream of the first conveyor roller pair in the conveying direction.

In the image recording apparatus configured as described above, the image can be recorded on the sheet without overlap thereof just under the recording device.

The present invention provides an image recording apparatus, including: a first conveyor roller pair provided in a first conveyance path and configured to convey a sheet in a conveying direction; a recording device provided downstream of the first conveyor roller pair in the conveying direction and configured to record an image on the sheet; a reversible roller pair provided downstream of the first conveyor roller pair in the conveying direction and including a first roller and a second roller, the reversible roller pair being configured to convey the sheet in the conveying direction and configured to convey the sheet to a second conveyance path that is connected to the first conveyance path at (i) a position located downstream of the first conveyor roller pair in the conveying direction and upstream of the reversible roller pair in the conveying direction and (ii) a position located upstream of the first conveyor roller pair in the conveying direction; a second conveyor roller pair disposed in the second conveyance path and configured to convey the sheet toward the first conveyor roller pair; a state switching mechanism configured to switch a state of the reversible roller pair between (a) a first state in which the first roller is pressed against the second roller and (b) a second state that is one of a state in which a force for pressing the first roller against the second roller is less than a force for pressing the first roller against the second roller in the first state and a state in which the first roller is spaced apart from the second roller; and a controller configured to control the reversible roller pair to convey the sheet along the second conveyance path until a leading edge of the sheet reaches a first position located downstream of the second conveyor roller pair in the conveying direction and upstream of the first conveyor roller pair in the conveying direction, and thereafter control the state switching mechanism to switch the state of the reversible roller pair from the first state to the second state.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIGS. 3A-3C are front elevational views schematically illustrating reversible roller pairs 43, wherein FIG. 3A illustrates a first state of each reversible roller pair 43, FIG. 3B illustrates a second state in which a reversible roller 45 and a spur 46 are held in contact with each other, and FIG. 3C illustrates a second state in which the reversible roller 45 and the spur 46 are spaced apart from each other;

FIGS. 12A and 12B are elevational views in vertical cross section schematically illustrating roller pairs 59, 66, 43, 70 illustrated in FIG. 7, wherein FIG. 12A illustrates the recording sheet 12 to explain a length L1, and FIG. 12B illustrates conveying directions 15, 16 to explain a length L2;

DETAILED DESCRIPTION OF THE EMBODIMENT

Figure 1:
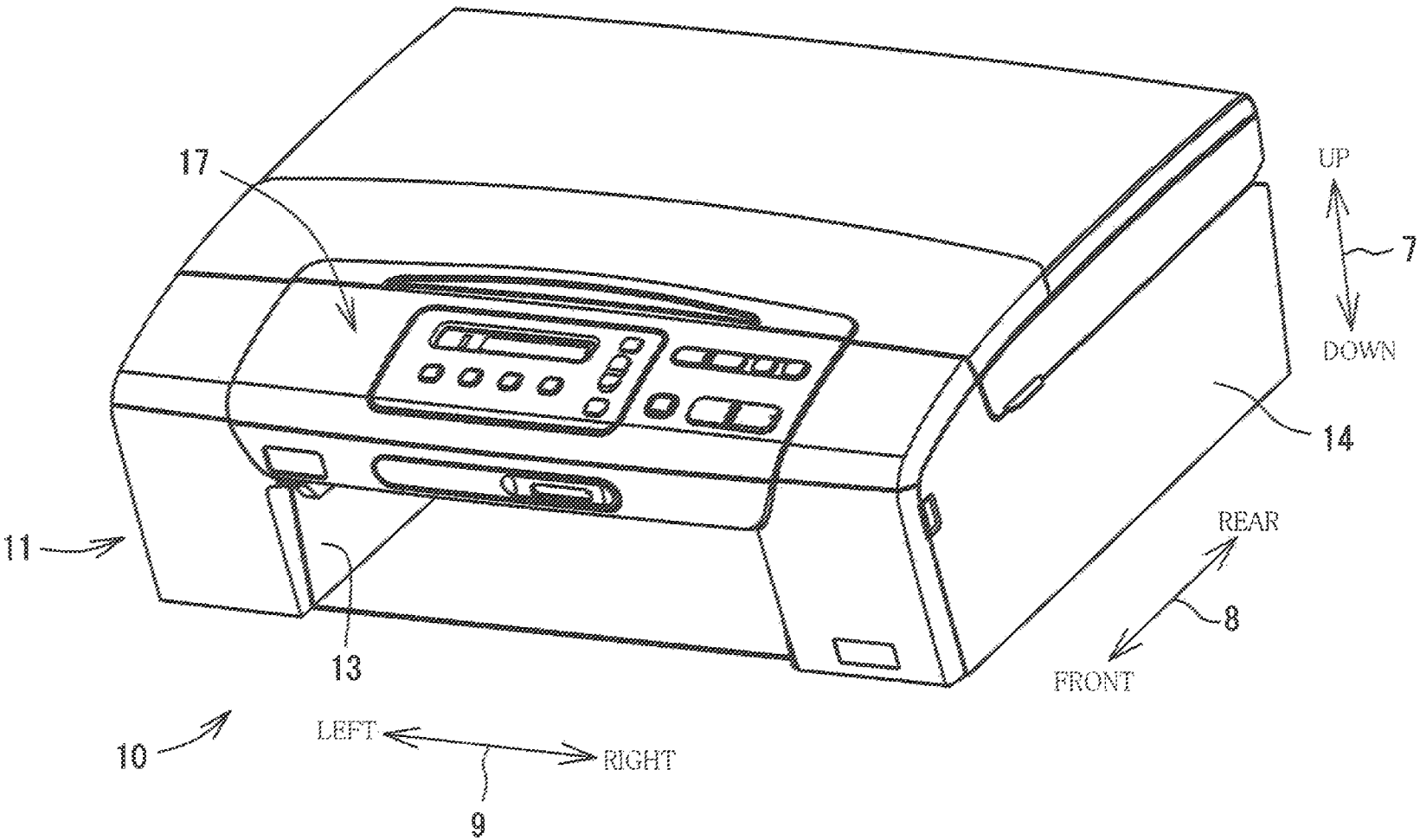
FIG. 1 is a perspective view illustrating a multi-function peripheral (MFP) 10.

Hereinafter, there will be described one embodiment of the present invention by reference to the drawings. It is to be understood that the following embodiment is described only by way of example, and the invention may be otherwise embodied with various modifications without departing from the scope and spirit of the invention. FIG. 1 illustrates a multi-function peripheral (MFP) 10 as one example of an image recording apparatus according to one embodiment of the present invention. In the following explanation, an up and down direction 7 is defined as an up and down direction of the MFP 10 illustrated in FIG. 1, i.e., the MFP 10 being in a normal state. A front and rear direction 8 is defined by regarding a side of the MFP 10 on which an opening 13 is formed as a front side, and a right and left direction 9 is defined in a state in which the MFP 10 is seen from the front side.

<Overall Structure of MFP 10>

As illustrated in FIG. 1, the MFP 10 includes a printing section 11 at its lower portion. The MFP 10 has various functions such as a facsimile function and a printing function. The printing function includes a duplex image recording function for recording images on front and back surfaces of a recording sheet 12 (see FIG. 2). The printing section 11 has the opening 13 in its front face. The MFP 10 includes: a supply tray 20 (see FIG. 2) and an output tray 21 (see FIG. 2) on which the recording sheet 12 is placeable. These trays 21, 22 can be inserted and removed through the opening 13 in the front and rear direction 8.

Figure 2:
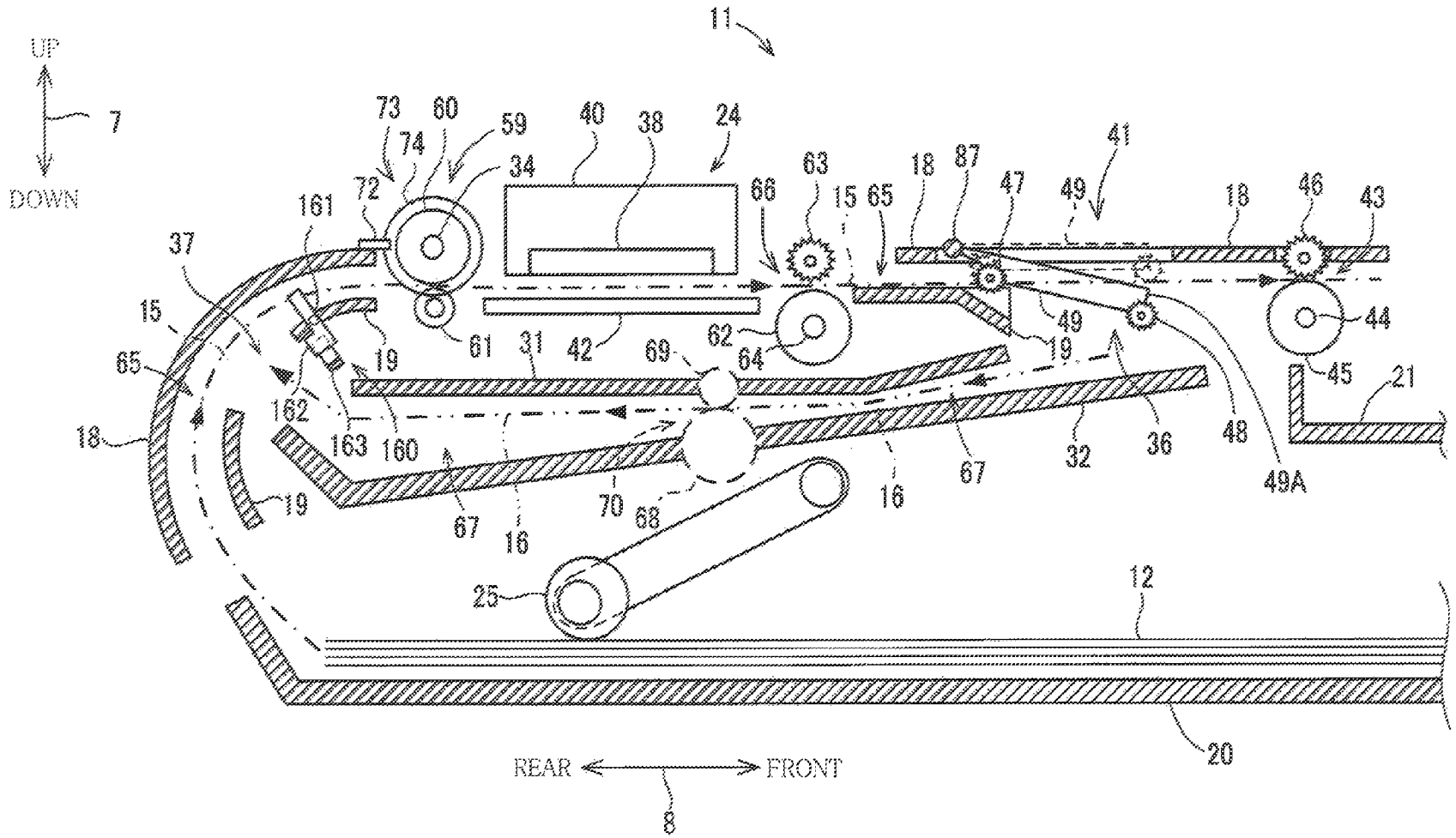
FIG. 2 is an elevational view in vertical cross section schematically illustrating an internal structure of a printing section 11.

As illustrated in FIG. 2, a supply roller 25 is provided on an upper side of the supply tray 20. The supply roller 25 is contactable with an upper surface of the recording sheet 12 placed on the supply tray 20. The supply roller 25 is rotated by receiving a driving force from a conveyor motor 71 (see FIG. 5) as one example of a drive motor. As a result, the recording sheet 12 placed on the supply tray 20 is supplied to a conveyor roller 60 through a first conveyance path 65. It is noted that power transmission from the conveyor motor 71 to the supply roller 25 will be explained later.

The first conveyance path 65 extends from a rear end portion of the supply tray 20. The first conveyance path 65 includes a curved portion and a straight portion. The first conveyance path 65 is defined by an outer guide member 18 and an inner guide member 19 which are opposed to each other at a predetermined distance therebetween. The recording sheet 12 placed on the supply tray 20 is conveyed through the curved portion from its lower side toward its upper side so as to make a U-turn. The recording sheet 12 is then conveyed to a recording unit 24 through the straight portion. The recording unit 24 performs image recording on the recording sheet 12. After the image recording, the recording sheet 12 is conveyed through the straight portion and discharged onto the output tray 21. That is, the recording sheet 12 is conveyed in a conveying direction indicated by one-dot chain-line arrow in FIG. 2. It is noted that the recording unit 24 will be explained later.

<Conveyor Roller 60, Output Roller 62, and Reversible Roller 45>

As illustrated in FIG. 2, a conveyor roller pair 59 (as one example of a first conveyor roller pair) is provided in the first conveyance path 65 at a position located upstream of the recording unit 24 in the conveying direction 15. The conveyor roller pair 59 is constituted by the conveyor roller 60 and a pinch roller 61. The pinch roller 61 is urged by a spring, for example, so as to be held in pressing contact with the conveyor roller 60. An output roller pair 66 is provided in the first conveyance path 65 at a position located downstream of the recording unit 24 in the conveying direction 15. The output roller pair 66 is constituted by an output roller 62 and a spur 63. The spur 63 is urged by a spring, for example, so as to be held in pressing contact with the output roller 62.

Reversible roller pairs 43 are provided in the first conveyance path 65 at a position located downstream of the output roller pair 66 in the conveying direction 15. The reversible roller pairs 43 have the same construction and the following explanation is provided for one reversible roller pair for the sake of simplicity unless otherwise required by context. The reversible roller pair 43 is constituted by a reversible roller 45 and a spur 46. In the present embodiment, as illustrated in FIG. 3, the reversible rollers 45 are spaced apart from each other in the right and left direction 9. A shaft 44 extends through the reversible rollers 45. The spurs 46 are spaced apart from each other in the right and left direction 9 and arranged opposite the respective reversible rollers 45. Each of the spurs 46 includes: a roller portion 141 contactable with a corresponding one of the reversible rollers 45; a rotation support portion 143 for supporting the roller portion 141 such that the roller portion 141 is rotatable about a shaft 142 extending in the right and left direction 9; and an urging member 144 for urging the support portion 143 and the roller portion 141 to the corresponding reversible roller 45. The urging member 144 is in the form of a spring, for example.

Each of the roller pairs 59, 66, 43 is rotated in a state in which the recording sheet 12 being conveyed in the first conveyance path 65 is nipped by each roller pair, so that the recording sheet 12 can be conveyed in the conveying direction 15 and a direction reverse to the conveying direction 15. Each of the conveyor roller 60, the output roller 62, and the reversible rollers 45 is rotated by receiving the driving force from the conveyor motor 71 via a drive-power transmitting mechanism 50 (see FIG. 4) which will be described below. The conveyor motor 71 is rotatable in its forward direction and reverse direction. When a driving force produced by the forward rotation of the conveyor motor 71 is transmitted to the conveyor roller 60, the conveyor roller 60 is rotated in its second rotational direction. Here, the second rotational direction of the conveyor roller 60 is a direction for conveying the recording sheet 12 in the conveying direction 15. When a driving force produced by the reverse rotation of the conveyor motor 71 is transmitted to the conveyor roller 60, the conveyor roller 60 is rotated in its first rotational direction that is reverse to the second rotational direction. Here, the first rotational direction of the conveyor roller 60 is a direction for conveying the recording sheet 12 in the direction reverse to the conveying direction 15.

Upon the duplex image recording, as will be described below, a direction of conveyance of the recording sheet 12 conveyed through the first conveyance path 65 is switched between the output roller pair 66 and the reversible roller pair 43 and conveyed to a second conveyance path 67 which will be described below.

<State Switching Mechanism 140>

Figures 3A, 3B, 3C:
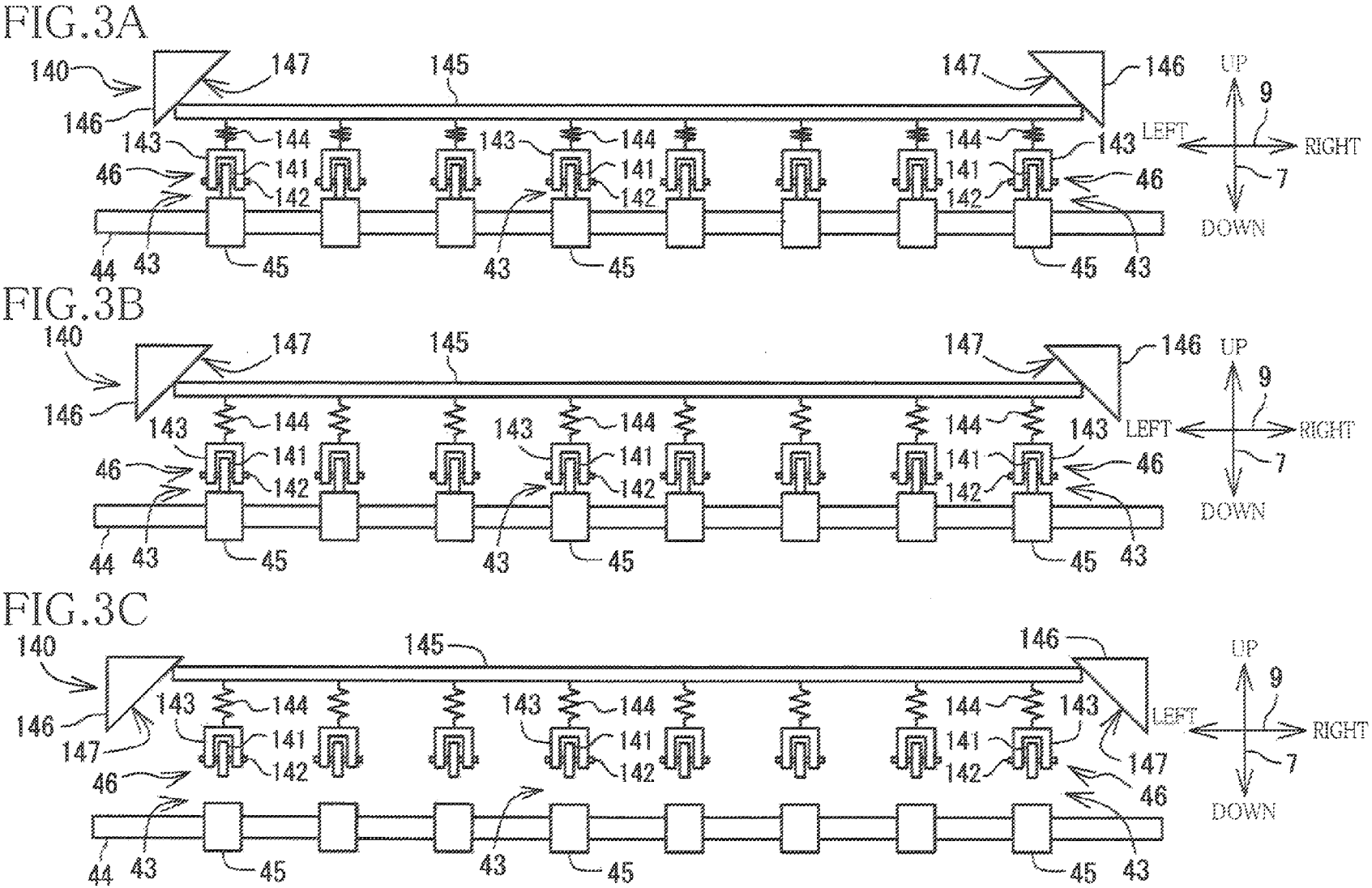

As illustrated in FIG. 3, the printing section 11 includes a state switching mechanism 140 (as one example of a state switching mechanism) that switches or changes a state of each reversible roller pair 43 between a first state and a second state. Here, as illustrated in FIG. 3A, the first state is a state in which one of a pair of rollers of the reversible roller pair 43 (the spur 46 in the present embodiment) is held in pressing contact with the other of the pair of rollers (the reversible roller 45 in the present embodiment). As illustrated in FIG. 3B, the second state is a state in which the one of the pair of rollers of the reversible roller pair 43 (the spur 46 in the present embodiment) is held in pressing contact with the other of the pair of rollers by a force smaller than that in the first state.

In the present embodiment, the state switching mechanism 140 includes a roller support portion 145 and a pair of movable members 146. The roller support portion 145 is a plate member extending in the front and rear direction 8 and the right and left direction 9 and is longer in the right and left direction 9 than in the front and rear direction 8. The roller support portion 145 is supported by a frame of the printing section 11, not shown, so as to be movable in the up and down direction 7. Also, an upper end of the urging member 144 of the spur 46 is connected to the roller support portion 145. It is noted that a lower end of the urging member 144 is connected to the rotation support portion 143.

The pair of movable members 146 are respectively provided on an upper side of opposite end portions of the roller support portion 145 in the right and left direction 9. The pair of movable members 146 are supported by the frame of the printing section 11, not shown, so as to be movable in the right and left direction 9 to change a distance between the pair of movable members 146. In the present embodiment, when one of the movable members 146 is moved leftward, the other of the movable members 146 is moved rightward in conjunction with the movement of the one of the movable members 146. In the present embodiment, attached to the pair of movable members 146 is a solenoid actuator, not shown, that is driven to move the pair of movable members 146. The pair of movable members 146 respectively have contact surfaces 147 that are respectively held in contact with right and left end portions of an upper face of the roller support portion 145. The contact surfaces 147 are inclined with respect to the right and left direction 9. Specifically, the contact surface 147 of the right movable member 146 is inclined such that its left end is located above its right end, and the contact surface 147 of the left movable member 146 is inclined such that its right end is located above its left end. As a result, the nearer to the right end of the right contact surface 147 a position where the roller support portion 145 and the right contact surface 147 are held in contact with each other is and the nearer to the left end of the left contact surface 147 a position where the roller support portion 145 and the left contact surface 147 are held in contact with each other is, the lower a position of the roller support portion 145 in the up and down direction 7 is.

Specifically, when the roller support portion 145 and the contact surfaces 147 are held in contact with each other at a position illustrated in FIG. 3A, the roller support portion 145 is located at a relatively low position. In this position, the urging member 144 has a length shorter than its natural length, and the roller portion 141 is held in contact with the reversible roller 45. That is, in the first state illustrated in FIG. 3A, the spur 46 is held in pressing contact with the reversible roller 45, in other words, the spur 46 presses the reversible roller 45.

When the pair of movable members 146 being in the state illustrated in FIG. 3A are moved in such a direction that increases their distance in the right and left direction 9, a state illustrated in FIG. 3B is established in which the roller support portion 145 is located above the roller support portion 145 being in the state illustrated in FIG. 3A. In this state, the urging member 144 has its natural length, and the roller portion 141 is held in contact with the reversible roller 45. That is, in the second state illustrated in FIG. 3B, the spur 46 is held in contact with the reversible roller 45 but not presses the reversible roller 45, in other words, the spur 46 is held in contact with the reversible roller 45 with no pressing force.

It is noted that the second state is not limited to the above-described state with no pressing force as long as the above-described pressing force is smaller than that in the first state. For example, when the height level of the roller support portion 145 is higher than that in the state illustrated in FIG. 3A and lower than that in the state illustrated in FIG. 3B, the above-described pressing force is larger than zero and smaller than that in the first state.

As illustrated in FIG. 3C, the second state may be a state in which the spur 46 is spaced apart from the reversible roller 45. Specifically, the pair of movable members 146 may be moved in the right and left direction 9 to establish a state in which the distance between the pair of movable members 146 is larger than that in the state illustrated in FIG. 3B. In this state, the roller support portion 145 is located above a position thereof in the state illustrated in FIG. 3B, so that the spur 46 is spaced apart from the reversible roller 45.

Also, the state switching mechanism 140 is not limited to having the above-described construction as long as the reversible roller pair 43 is switchable between the first state and the second state. For example, the state switching mechanism 140 may be configured such that the mechanism 140 does not include the movable members 146, a solenoid actuator is attached to the roller support portion 145, and the solenoid actuator is driven to move the roller support portion 145 upward and downward to move the spur 46 upward and downward.

Also, the state switching mechanism 140 may move the reversible roller 45 upward and downward instead of the spur 46 and may move both of the spur 46 and the reversible roller 45 upward and downward.

<Recording Unit 24>

As illustrated in FIG. 2, the recording unit 24 is provided downstream of the conveyor roller pair 59 in the conveying direction and upstream of the output roller pair 66 in the conveying direction 15. A platen 42 is provided under the recording unit 24 so as to be opposed to the recording unit 24. The platen 42 supports the recording sheet 12 conveyed through the first conveyance path 65. The recording unit 24 employs a well-known ink-jet ejection method to record an image on the recording sheet 12 supported on the platen 42. The recording unit 24 includes: a recording head 38 having a multiplicity of nozzles through which the recording head 38 ejects ink droplets onto the recording sheet 12; and a carriage 40 for holding the recording head 38 mounted thereon.

The carriage 40 is supported by, e.g., the frame of the printing section 11 so as to be reciprocable in the right and left direction 9 perpendicular to the front and rear direction 8. The carriage 40 is coupled to a carriage drive motor 53 (see FIG. 5) by a well-known belt mechanism. Upon receipt of a driving force transmitted from the carriage drive motor 53, the carriage 40 is reciprocated in the right and left direction 9. This reciprocation of the carriage 40 is performed in a state in which the recording sheet 12 is supported on the platen 42. The recording head 38 ejects ink droplets from the nozzles in the reciprocation of the carriage 40. During this recording, a microcomputer 130 which will be described below alternately controls (i) the conveyor motor 71 to rotate the conveyor roller 60 to convey the recording sheet 12 by a predetermined linefeed distance (as one example of a conveyance operation) and (ii) the carriage drive motor 53 and the recording head 38 to perform the reciprocating movement of the carriage 40 and the ink ejection from the recording head 38 (as one example of a recording operation). As a result, an image is formed on the recording sheet 12 supported on the platen 42. It is noted that a method for recording an image on the recording sheet 12 is not limited to the ink-jet method, and an electronic photographic method may be employed, for example.

<Path Switching Member 41 and Second Conveyance Path 67>

As illustrated in FIG. 2, a path switching member 41 is provided in the first conveyance path 65 at a position between the output roller pair 66 and the reversible roller pair 43. The path switching member 41 includes auxiliary rollers 47, 48, a flap 49, and a shaft 87. The flap 49 is pivotably supported by the shaft 87 so as to extend from the shaft 87 substantially in the conveying direction 15. The auxiliary rollers 47, 48 each having a spur shape are provided respectively on shafts that are provided on the flap 49.

The flap 49 is pivoted between (i) a discharge orientation indicated by broken lines in FIG. 2 which allows the recording sheet 12 to be discharged onto the output tray 21 and (ii) a reverse orientation indicated by solid lines in FIG. 2 in which a free end portion 49A of the flap 49 is located at a position lower than that in the discharge orientation.

In a standby state of the MFP 10, the flap 49 is located at the reverse orientation by its own weight. When a leading edge of the recording sheet 12 being conveyed along the first conveyance path 65 comes into contact with the flap 49, the flap 49 is pivoted upward to the discharge orientation. When a trailing edge of the recording sheet 12 (i.e., an upstream edge of the recording sheet 12 in the conveying direction 15) has passed through the auxiliary roller 47, the flap 49 is pivoted by its own weight from the discharge orientation to the reverse orientation. This pivot movement lowers the trailing edge of the recording sheet 12 conveyed. As a result, the trailing edge of the recording sheet 12 is directed to the second conveyance path 67 which will be described below. When the reversible rollers 45 continue to be rotated in the second rotational direction in this state, the recording sheet 12 is conveyed in the conveying direction 15 and discharged onto the output tray 21. On the other hand, when a rotational direction of the reversible rollers 45 is switched to the first rotational direction, the recording sheet 12 is conveyed in the direction reverse to the conveying direction 15 so as to enter into the second conveyance path 67. In view of the above, the rotation of the reversible roller pair 43 in the second rotational direction conveys the recording sheet 12 in the conveying direction 15, and the rotation of the reversible roller pair 43 in the first rotational direction conveys the recording sheet 12 in the direction reverse to the conveying direction 15, i.e., to the second conveyance path 67.

The second conveyance path 67 branches off from the first conveyance path 65 at a first connecting position 36 located downstream of the output roller pair 66 in the conveying direction 15 and upstream of the reversible roller pair 43 in the conveying direction 15, and the second conveyance path 67 merges with the first conveyance path 65 at a second connecting position 37 located upstream of the conveyor roller pair 59 in the conveying direction 15. That is, the second conveyance path 67 is connected to the first conveyance path 65 at the first connecting position 36 and the second connecting position 37. It is noted that the second conveyance path 67 is defined by guide members 31, 32.

<Sheet Position Determiner>

A sheet position determiner determines or recognizes a position of the recording sheet 12 in the first conveyance path 65 and the second conveyance path 67, i.e., a position of the recording sheet 12 in the conveying direction 15. In the present embodiment, the sheet position determiner includes a sensor 160 (as one example of a sheet sensor) and a rotary encoder 73 (as one example of a rotational amount sensor).

As illustrated in FIG. 2, the sensor 160 is provided in the first conveyance path 65 at a position located upstream of the conveyor roller 60 in the conveying direction 15 and downstream of the second connecting position 37 in the conveying direction 15. It is noted that the sensor 160 may not be provided at the position and may be provided in the second conveyance path 67 or at any position other than the position in the first conveyance path 65. Also, a plurality of sensors may be provided in the printing section 11 instead of the single sensor 160. For example, the sensor 160 may be provided in each of the first conveyance path 65 and the second conveyance path 67. That is, the sensor 160 only needs to be provided in at least one of the first conveyance path 65 and the second conveyance path 67.

In the present embodiment, the sensor 160 includes: a shaft 161; a detector 162 pivotable about the shaft 161; and an optical sensor 163 that includes a light emitting element and a light receiving element for receiving light emitted from the light emitting element. One end of the detector 162 projects to the first conveyance path 65. When an external force is not applied to the one end of the detector 162, the other end of the detector 162 is located in a light path extending from the light emitting element to the light receiving element to interrupt the light traveling through the light path. In this state, the optical sensor 163 outputs a low-level signal to the microcomputer 130 which will be described below. When the one end of the detector 162 is pressed and rotated by the leading edge of the recording sheet 12, the other end of the detector 162 is moved out of the light path, causing the light to pass through the light path. In this state, the optical sensor 163 outputs a high-level signal to the microcomputer 130. With these operations, the sensor 160 senses the upstream and downstream edges of the recording sheet 12 in the conveying direction 15.

The rotary encoder 73 is provided on the conveyor roller 60. The rotary encoder 73 produces pulse signals in response to the rotation of the conveyor roller 60. It is noted that the rotary encoder 73 may be provided on any roller other than the conveyor roller 60, for example, the rotary encoder 73 may be provided on the output roller 62, the reversible rollers 45, or a re-conveying roller 68 which will be described below.

The rotary encoder 73 includes an optical sensor 72 and an encoder disc 74 that is provided on a shaft 34 of the conveyor roller 60 so as to be rotated together with the conveyor roller 60. The encoder disc 74 includes: light transmitting portions allowing light to pass therethrough; and light intercepting portions inhibiting the light from passing therethrough. These light transmitting portions and light intercepting portions are alternately arranged at regular pitches in a circumferential direction so as to form a predetermined pattern. The rotary encoder 73 produces a pulse signal each time when the light transmitting portion and the light intercepting portion are sensed by the optical sensor 72 during the rotation of the encoder disc 74. The produced pulse signals are transmitted to the microcomputer 130. The rotary encoder 73 thus senses a rotational amount of the conveyor roller 60.

The microcomputer 130 which will be described below determines the position of the recording sheet 12 in the conveying direction 15, based on signals sent from the sensor 160 and the rotary encoder 73. For example, in the present embodiment, the microcomputer 130 determines a current position of the downstream edge of the recording sheet 12 in the conveying direction 15, based on a rotational amount of the conveyor roller 60 which is sensed after the sense of the downstream edge of the recording sheet 12 in the conveying direction 15 by the sensor 160. In view of the above, functions of the sheet position determiner are achieved by the sensor 160, the rotary encoder 73, and the microcomputer 130.

It is noted that the sheet position determiner is not limited to having the above-described structure as long as the sheet position determiner can determine the position of the recording sheet 12 in the conveying direction 15. For example, the sheet position determiner may determine the position of the recording sheet 12 in the conveying direction 15, based on a length of time elapsed from a start of supply of the recording sheet 12 from the supply tray 20.

<Drive-Power Transmitting Mechanism 50>

Figure 4A:
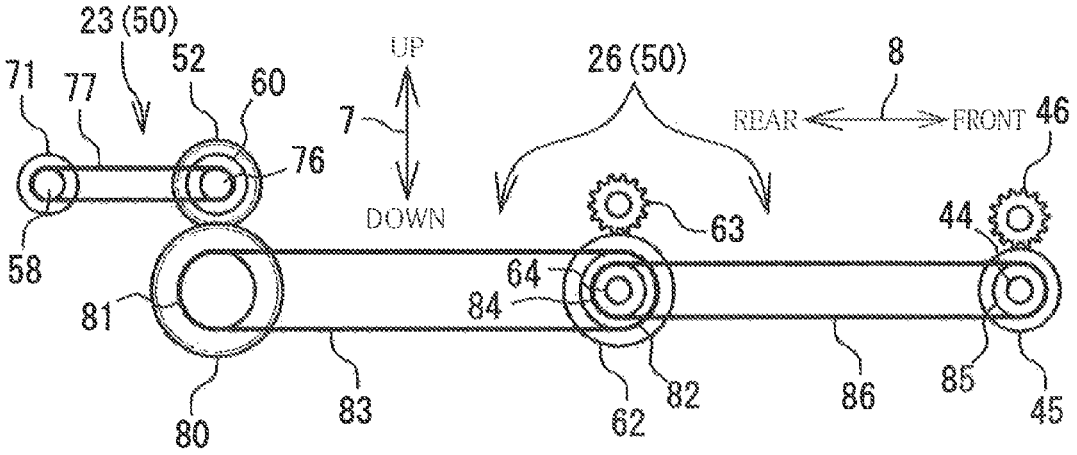
FIG. 4A is a left side view schematically illustrating a first drive-power transmitting mechanism 23, a second drive-power transmitting mechanism 26, and their peripheral portion.
Figure 4B:
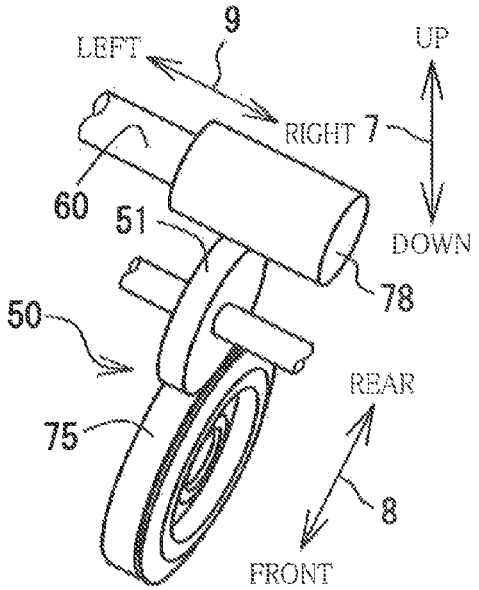
FIG. 4B is a perspective view schematically illustrating a switch gear 51 located at a meshing position and its peripheral portion.
Figure 4C:
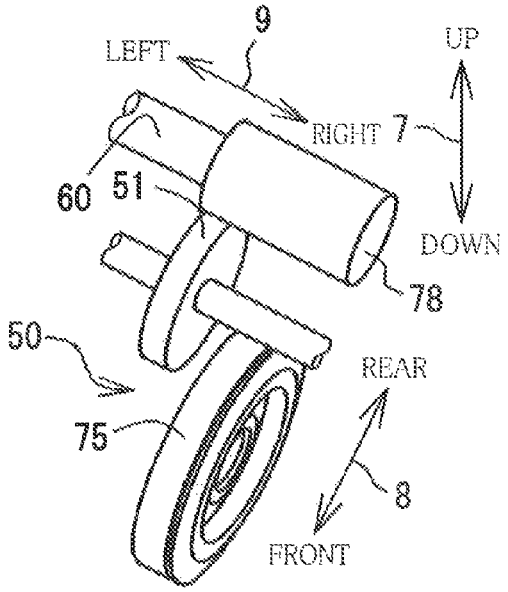
FIG. 4C is a perspective view schematically illustrating the switch gear 51 located at a neutral position and its peripheral portion.

The printing section 11 includes the drive-power transmitting mechanism 50 as illustrated in FIGS. 4A and 4B. The drive-power transmitting mechanism 50 includes a first drive-power transmitting mechanism 23, a second drive-power transmitting mechanism 26, a third drive-power transmitting mechanism 27, a switch gear 51, a first gear 78, and a second gear 75. It is noted that the drive-power transmitting mechanism 50 is not limited to having a construction explained below as long as the drive-power transmitting mechanism 50 has a function of sending the rollers 25, 60, 62, 45 the driving force produced by the rotation of the conveyor motor 71.

As illustrated in FIG. 4A, the first drive-power transmitting mechanism 23 includes a motor pulley 58, a roller pulley 76, and an endless first belt 77. The motor pulley 58 is mounted on a shaft of the conveyor motor 71. The roller pulley 76 is mounted on the shaft 34 of the conveyor roller 60. The first belt 77 is looped over the motor pulley 58 and the roller pulley 76. With this construction, the first drive-power transmitting mechanism 23 transmits the driving force of the conveyor motor 71 to the conveyor roller 60.

As illustrated in FIG. 4A, the second drive-power transmitting mechanism 26 includes an upper gear 52, a lower gear 80, a first pulley 81, a second pulley 82, a third pulley 84, a fourth pulley 85, a second belt 83, and a third belt 86. The upper gear 52 is provided on the shaft 34 of the conveyor roller 60 and located to the left of the first conveyance path 65. The lower gear 80 is provided under the upper gear 52 and meshed with the upper gear 52. The first pulley 81 is mounted on a left side of the lower gear 80 and rotated coaxially and together with the lower gear 80. As a result, the first pulley 81 is rotated by the rotation of the conveyor roller 60. The second pulley 82 is mounted on a shaft 64 of the output roller 62. The endless second belt 83 is looped over the first pulley 81 and the second pulley 82. Thus, the rotation of the conveyor roller 60 rotates the second belt 83. As a result, the driving force of the conveyor roller 60 is transmitted to the output roller 62.

The third pulley 84 is mounted on the shaft 64 on a left side of the second pulley 82 so as to be rotated coaxially and together with the second pulley 82. The fourth pulley 85 is mounted on the shaft 44 of the reversible rollers 45. The endless third belt 86 is looped over the third pulley 84 and the fourth pulley 85. As a result, the driving force of the output roller 62 is transmitted to the reversible rollers 45. That is, the reversible rollers 45 are rotated by receiving the driving force from the output roller 62.

As described above, the driving force is transmitted from the conveyor motor 71 to the conveyor roller 60, the output roller 62, and the reversible rollers 45 via the first drive-power transmitting mechanism 23 and the second drive-power transmitting mechanism 26. With this construction, when the conveyor roller 60 is rotated in the direction for conveying the recording sheet 12 in the conveying direction 15, the output roller 62 and the reversible rollers 45 are also rotated in the direction for conveying the recording sheet 12 in the conveying direction 15. When the conveyor roller 60 is rotated in the direction for conveying the recording sheet 12 in the direction reverse to the conveying direction 15, the output roller 62 and the reversible rollers 45 are also rotated in the direction for conveying the recording sheet 12 in the direction reverse to the conveying direction 15. That is, the reversible rollers 45 are rotated in the direction for conveying the recording sheet 12 to the second conveyance path 67.

That is, when the conveyor roller 60 is rotated in the second rotational direction, the output roller 62 and the reversible rollers 45 are also rotated in the second rotational direction. When the conveyor roller 60 is rotated in the first rotational direction, the output roller 62 and the reversible rollers 45 are also rotated in the first rotational direction. In view of the above, the conveyor roller 60, the output roller 62, and the reversible rollers 45 are rotated forwardly or reversely by the same conveyor motor 71 so as to convey the recording sheet 12 in the same direction. Also, the first drive-power transmitting mechanism 23 and the second drive-power transmitting mechanism 26 are one example of a power transmission.

As illustrated in FIG. 4B, the first gear 78 is provided on the shaft 34 of the conveyor roller 60 (FIG. 2) and located to the right of the first conveyance path 65 (see FIG. 2). The switch gear 51 is meshed with the first gear 78. The second gear 75 is disposed so as to be meshable with the switch gear 51. The switch gear 51 is movable in the right and left direction 9. In the present embodiment, the switch gear 51 is, as will be described below, movable between a meshing position (illustrated in FIG. 4B) at which the switch gear 51 is meshed with the second gear 75 and a neutral position (illustrated in FIG. 4C) at which the switch gear 51 is not meshed with the second gear 75. A well-known mechanism is used for moving the switch gear 51. For example, the switch gear 51 may be moved in the right and left direction 9 by a driving force transmitted from an actuator. Also, the switch gear 51 may be moved rightward by pressing of the carriage 40 moving in the right and left direction 9 and moved leftward by an urging force of a spring attached to the switch gear 51.

Figure 4D:
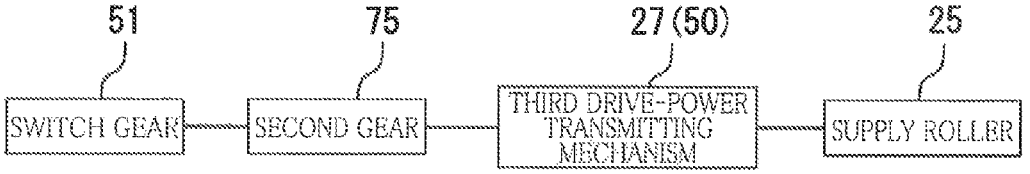
FIG. 4D is a block diagram illustrating power transmission from the switch gear 51 to a supply roller 25.

When the switch gear 51 is located at the meshing position, the driving force transmitted from the conveyor motor 71 to the switch gear 51 is, as illustrated in FIG. 4D, transmitted to the supply roller 25 via the second gear 75 and the third drive-power transmitting mechanism 27. The third drive-power transmitting mechanism 27 is constituted by gears and belts. For example, the third drive-power transmitting mechanism 27 includes a planetary gear mechanism and rotates the supply roller 25 only in one rotational direction, specifically, in a rotational direction for supplying the recording sheet 12 from the supply tray 20 to the first conveyance path 65. On the other hand, when the switch gear 51 is located at the neutral position, the driving force transmitted from the conveyor motor 71 to the switch gear 51 is not transmitted to the supply roller 25. That is, when the position of the switch gear 51 is switched, the presence or absence of the rotation of the supply roller 25 is switched, in other words, the presence or absence of supply of the recording sheet 12 placed on the supply tray 20 to the first conveyance path 65 is switched.

<Microcomputer 130>

Figure 5:
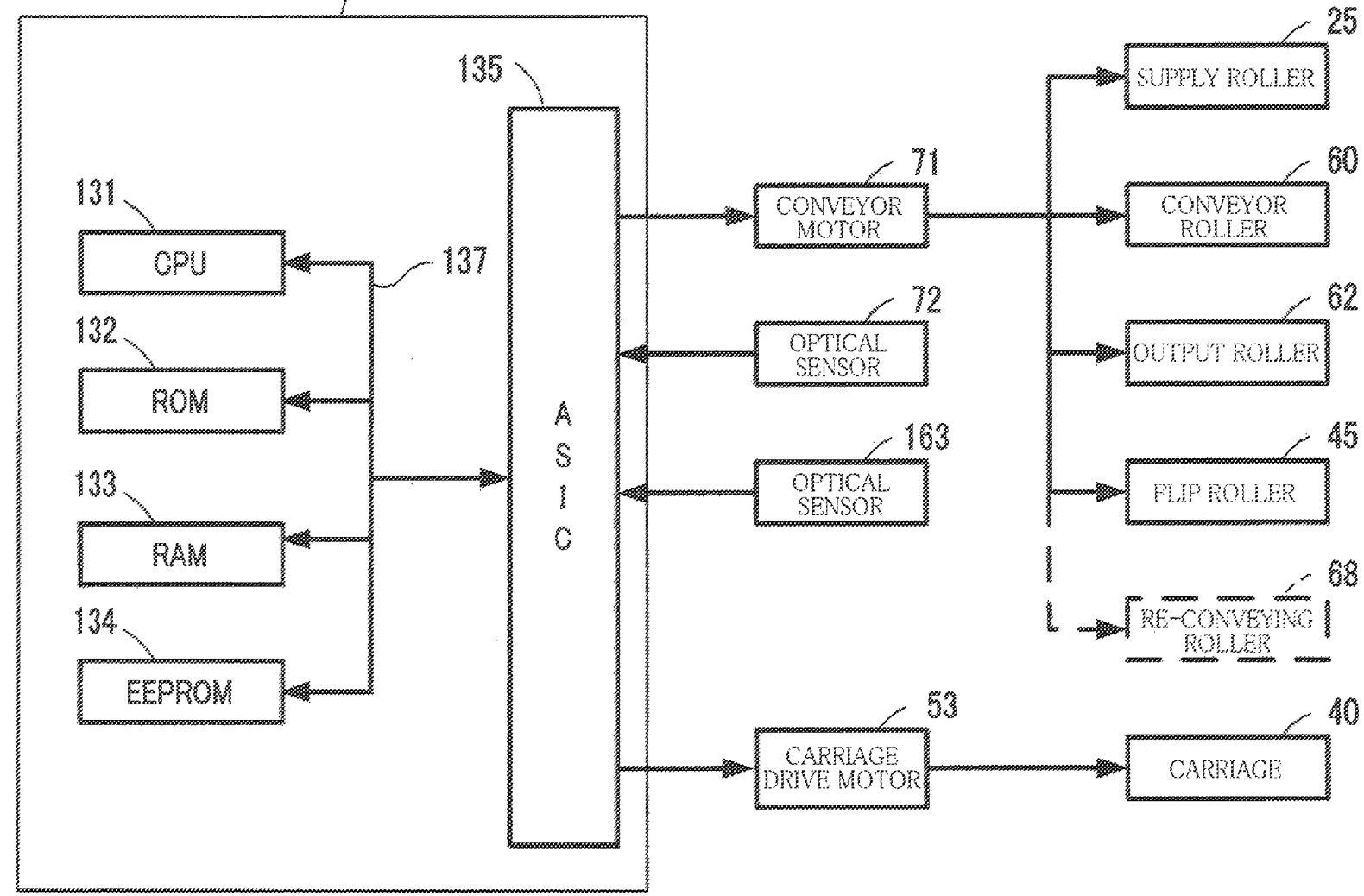
FIG. 5 is a block diagram illustrating a configuration of a microcomputer 130.

The microcomputer 130 illustrated in FIG. 5 controls overall operations of the MFP 10. For example, the microcomputer 130 controls the conveyor motor 71. Also, the microcomputer 130 controls the carriage drive motor 53 to move the carriage 40. The microcomputer 130 includes a CPU 131, a ROM 132, a RAM 133, an EEPROM 134, an ASIC 135, and an internal bus 137 for connecting these devices to each other.

The ROM 132 stores various programs and data for the CPU 131 to control various operations. The RAM 133 is used as a storage area for temporarily storing, e.g., data and signals used when the CPU 131 executes the programs. The EEPROM 134 is for storing settings, flags, and other similar data which should be kept after the MFP 10 is turned off.

Devices connected to the ASIC 135 include the conveyor motor 71, the carriage drive motor 53, and the solenoid actuator, not shown, for moving the movable members 146. When a drive signal for driving each motor or the solenoid actuator is input from the CPU 131 to a corresponding drive circuit, a drive current related to the drive signal is output from the drive circuit to the motor or the solenoid actuator, causing the motor to be rotated forwardly or reversely at a predetermined rotational speed or the solenoid actuator to be driven.

Also, a pulse signal output from the optical sensor 72 of the rotary encoder 73 is input to the ASIC 135. Based on this pulse signal transmitted from the optical sensor 72, the microcomputer 130 detects the rotational amount of the conveyor roller 60. Also, the optical sensor 163 of the sensor 160 is coupled to the ASIC 135. Based on a signal transmitted from the optical sensor 163, the microcomputer 130 detects the downstream edge and the upstream edge of the recording sheet 12 in the conveying direction 15 at the position of the sensor 160. The microcomputer 130 determines the positions of the upstream edge and the downstream edge of the recording sheet 12 being conveyed in the conveying direction 15, based on the rotational amount of the conveyor roller 60 and a timing at which the sensor 160 senses the downstream edge and the upstream edge of the recording sheet 12 in the conveying direction 15.

In an image recording control which will be described below, the microcomputer 130 controls the state switching mechanism 140 to switch the state of the reversible roller pair 43 at a predetermined timing which will be described below. The microcomputer 130 is one example of a controller.

<Image Recording Control>

Figure 6:
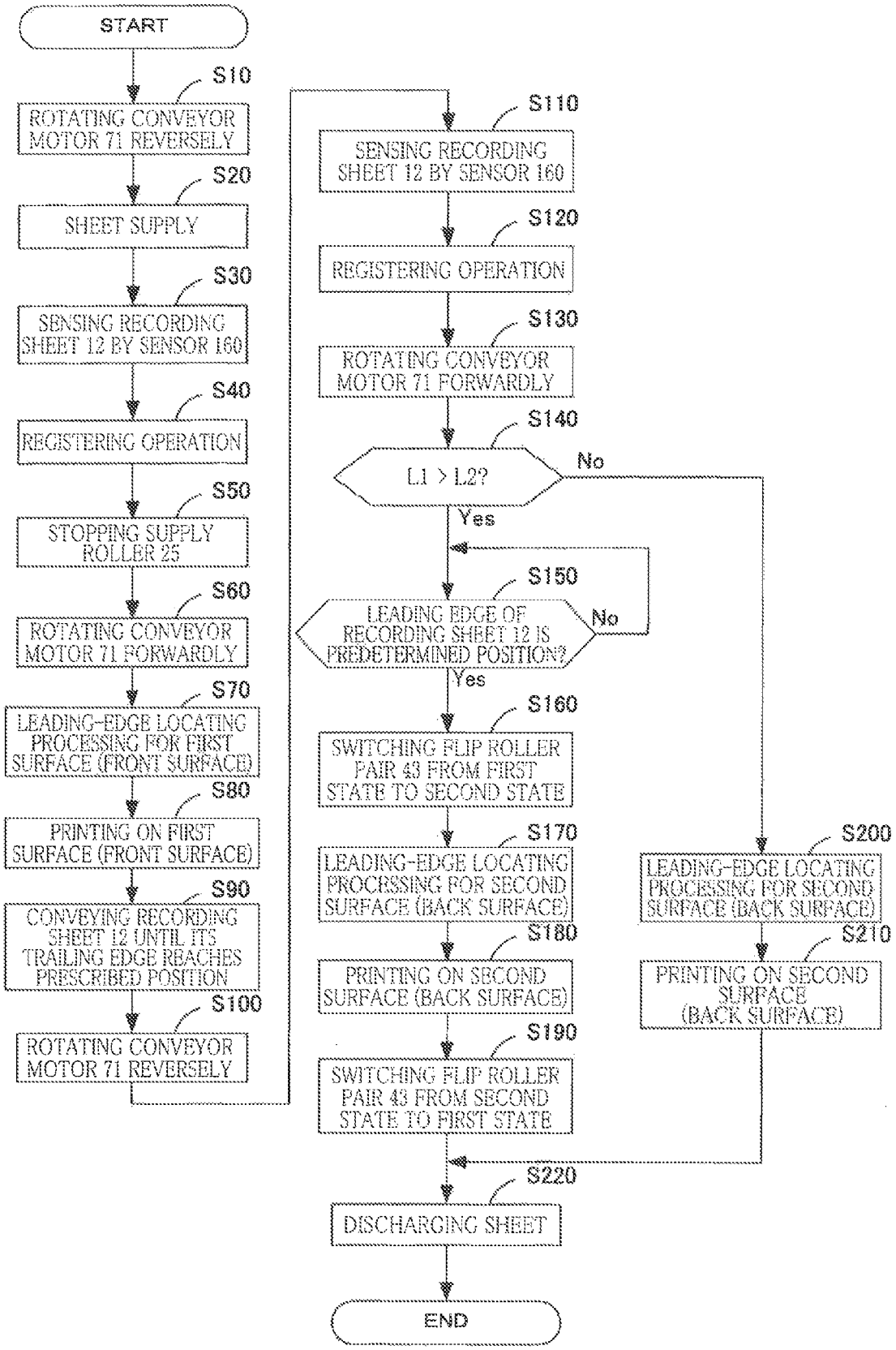
FIG. 6 is a flow chart illustrating a procedure of processings executed by the microcomputer 130 to perform duplex image recording on a recording sheet 12.

There will be next explained, with reference to the flow chart in FIG. 6, a procedure of processings that are executed by the microcomputer 130 to perform the duplex image recording on the recording sheet 12. In the following explanation, it is assumed that the microcomputer 130 controls an actuator to control the switch gear 51 (see FIG. 4) to switch between the meshing position (indicated in FIG. 4B) at which the switch gear 51 is meshed with the second gear 75 and the neutral position (indicated in FIG. 4C) at which the switch gear 51 is not meshed with the second gear 75. This actuator is used only for the switching of the switch gear 51. Also, in the following explanation, an initial position of the switch gear 51 is the meshing position (indicated in FIG. 4B).

For example, when a user operates an operation panel 17 (see FIG. 1) to command the duplex printing, the microcomputer 130 at S10 rotates the conveyor motor 71 in the reverse direction. As a result, the supply roller 25 is rotated. Also, the reverse rotation of the conveyor motor 71 at S10 rotates the conveyor roller 60, the output roller 62, and the reversible rollers 45 in the first rotational direction, i.e., in the direction for conveying the recording sheet 12 in the direction reverse to the conveying direction 15.

The rotation of the supply roller 25 at S20 supplies the recording sheet 12 placed on the supply tray 20, to the first conveyance path 65. When the leading edge of the supplied recording sheet 12, i.e., the downstream edge of the recording sheet 12 in the conveying direction 15, has reached the sensor 160, the sensor 160 at S30 senses the leading edge of the recording sheet 12. In the present embodiment, when the supply roller 25 is rotated by a predetermined rotational amount after the recording sheet 12 is sensed by the sensor 160, the microcomputer 130 determines that the leading edge of the recording sheet 12 conveyed in the conveying direction 15 has reached the conveyor roller pair 59.

The microcomputer 130 continues the rotation of the conveyor roller 60 in the first rotational direction for a predetermined length of time after the leading edge of the recording sheet 12 conveyed in the conveying direction 15 is brought into contact with the conveyor roller 60. As a result, what is called a registering operation is operated at S40 to correct skew of the recording sheet 12 being held in contact with the conveyor roller 60. After the registering operation, the microcomputer 130 stops the conveyor motor 71. The microcomputer 130 then moves the switch gear 51 from the meshing position to the neutral position to stop the supply roller 25 at S50. The microcomputer 130 at S60 rotates the conveyor motor 71 in the forward direction, so that the conveyor roller 60 conveys the recording sheet 12 in the conveying direction 15.

At S70, the microcomputer 130 executes a leading-edge locating processing for the recording sheet 12 whose first surface, i.e., front surface, is to be printed. Specifically, when the leading edge of the recording sheet 12 conveyed in the conveying direction 15 has reached a printing start position that is opposed to the recording unit 24, the microcomputer 130 stops the conveyor motor 71. As a result, the conveyor roller 60 is stopped to stop the recording sheet 12. Here, the printing start position is a position at which a leading edge of an image recording area of the recording sheet 12, i.e., a downstream edge of the image recording area in the conveying direction 15 is opposed to the most upstream nozzles 39 in the conveying direction 15 among a multiplicity of nozzles 39 formed in the recording head 38.

Upon completion of the leading-edge locating processing at S70, the microcomputer 130 at S80 executes an image recording processing for the first surface of the recording sheet 12. Specifically, the microcomputer 130 alternately executes (i) a processing for controlling the recording head 38 to eject ink droplets from the nozzles 39 onto the recording sheet 12 supported on the platen 42 while moving the carriage 40 in the right and left direction 9 and (ii) a processing for controlling the conveyor roller 60 to convey the recording sheet 12 in the conveying direction 15 by the predetermined linefeed distance.

Upon completion of the image recording, the microcomputer 130 rotates the conveyor motor 71 in the forward direction to rotate the conveyor roller 60, the output roller 62, and the reversible rollers 45 in the second rotational direction to convey the recording sheet 12 in the conveying direction 15. When the leading edge of the recording sheet 12 conveyed in the conveying direction 15 has reached the path switching member 41, the recording sheet 12 causes the upward pivot movement of the path switching member 41 to switch the path switching member 41 from the reverse orientation to the discharge orientation. In this state, the reversible rollers 45 are rotated in the second rotational direction, so that the recording sheet 12 continues to be conveyed toward the output tray 21. At S90, the conveyor motor 71 is stopped when the trailing edge of the recording sheet 12 conveyed in the conveying direction 15 (i.e., the upstream edge of the recording sheet 12 in the conveying direction 15) has reached a prescribed position located between the auxiliary roller 47 and the auxiliary roller 48. When the trailing edge of the recording sheet 12 has reached the prescribed position, a force due to the weight of the path switching member 41 becomes larger than a force of the recording sheet 12 for pivoting the path switching member 41 upward, so that the path switching member 41 is switched from the discharge orientation to the reverse orientation. As a result, the trailing edge of the recording sheet 12 conveyed in the conveying direction 15 is pushed downward by the auxiliary roller 48 so as to be directed to the second conveyance path 67.

The microcomputer 130 at S100 rotates the conveyor motor 71 in the reverse direction, so that the conveyor roller 60, the output roller 62, and the reversible rollers 45 are rotated in the first rotational direction.

As a result of the processing at S100, the conveying direction of the recording sheet 12 is switched to the direction reverse to the conveying direction 15, so that the upstream edge of the recording sheet 12 in the conveying direction 15 is directed to the second conveyance path 67, and the recording sheet 12 is conveyed to the second conveyance path 67. The recording sheet 12 conveyed into the second conveyance path 67 is conveyed from the first connecting position 36 to the second connecting position 37 along the second conveyance path 67. In the following processings for printing on a second surface (i.e., a back surface) of the recording sheet, the leading edge and the trailing edge of the recording sheet 12 are interchanged compared with the conveyance for the printing on the first surface (i.e., the front surface). That is, the trailing edge of the recording sheet 12 (i.e., the upstream edge of the recording sheet 12 in the conveying direction 15) in the case of the printing on the first surface (i.e., the front surface) becomes the leading edge of the recording sheet 12 conveyed along the second conveyance path 67, and the leading edge of the recording sheet 12 (i.e., the downstream edge of the conveying direction 15) in the case of the printing on the first surface (i.e., the front surface) becomes the trailing edge of the recording sheet 12 conveyed along the second conveyance path 67.

After the recording sheet 12 is conveyed from the second connecting position 37 to the first conveyance path 65 again, when its leading edge has reached the sensor 160, the leading edge is sensed by the sensor 160 at S110. As in the processing at S40, the registering operation is performed at S120, and then the microcomputer 130 at S130 rotates the conveyor motor 71 in the forward direction.

In the present embodiment, when the rotational direction of the conveyor motor 71 is switched from the reverse direction to the forward direction at S130 to rotate the conveyor roller 60, the output roller 62, and the reversible rollers 45 in the second rotational direction, the conveyor roller pair 59 and the reversible roller pair 43 both nipping the recording sheet 12 pull the recording sheet 12 to their respective sides. To solve this problem, in the present embodiment, the conveying force of the conveyor roller pair 59 is set to be larger than the conveying force of the reversible roller pair 43. Here, the conveying force is a force of a roller pair for conveying the recording sheet 12 and determined, for example, by a speed of rotation, a material, and a nipping force of rollers of the roller pair. Since a force of the conveyor roller pair 59 for conveying the recording sheet 12 is larger than that of the reversible roller pair 43 for conveying the recording sheet 12, the conveyor roller pair 59 can pull the recording sheet 12 off from the reversible roller pair 43 to convey the recording sheet 12.

Figure 12A:
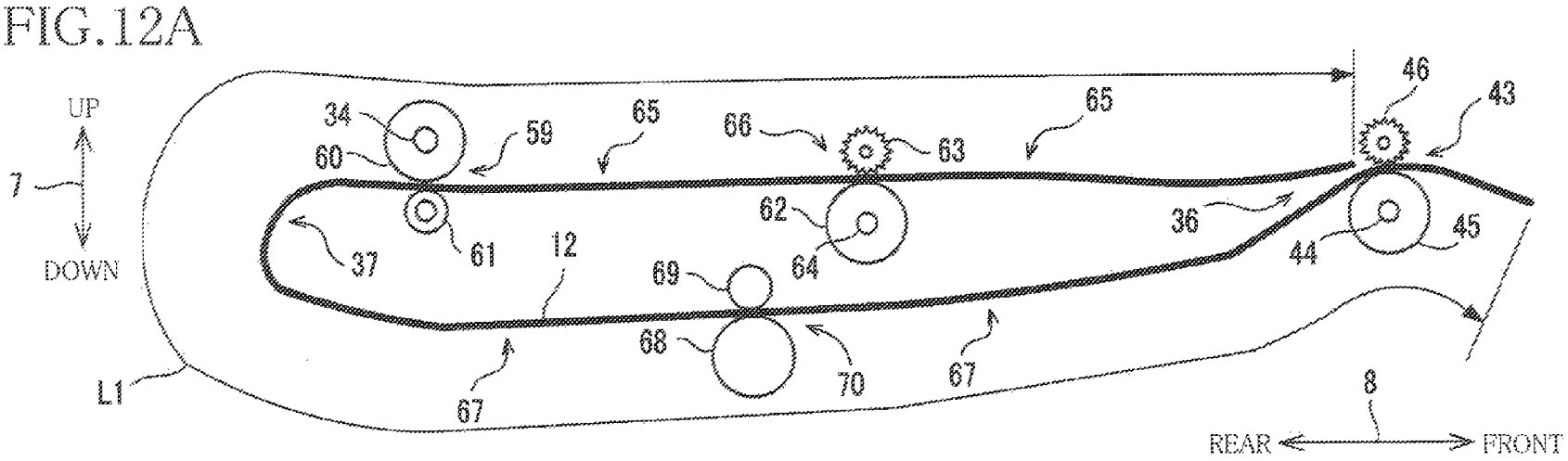
Figure 12B:
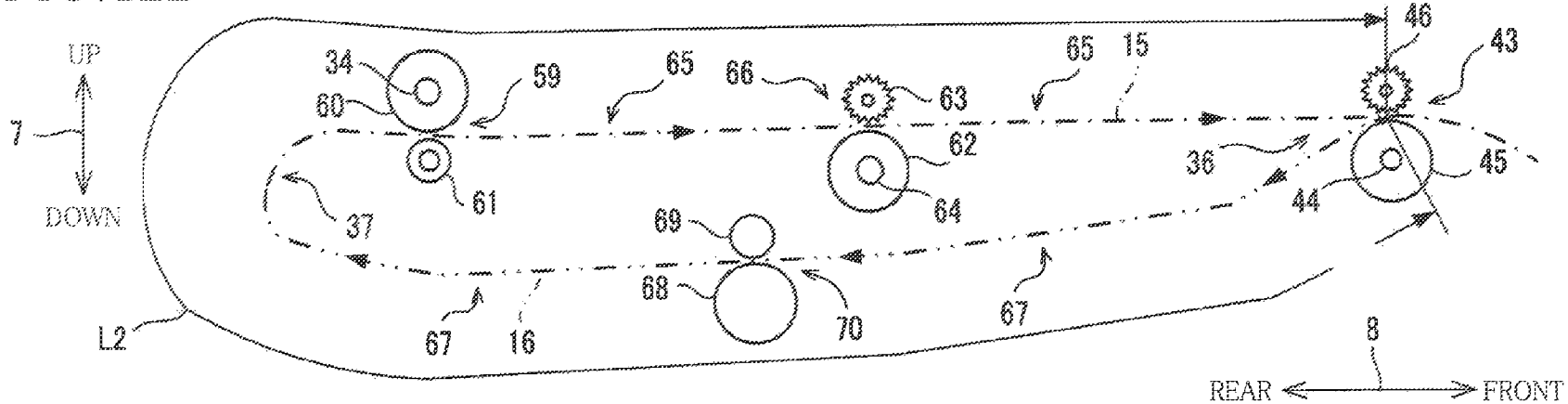

At S140, the microcomputer 130 determines whether a length of the recording sheet 12 along the first conveyance path 65 and the second conveyance path 67, i.e., a length L1 along the conveying direction 15 (see FIG. 12A) is longer than a length L2 (see FIG. 12B) or not. Here, the length L1 is a length of the recording sheet 12 in the front and rear direction 8 in a state in which the recording sheet 12 is placed on the supply tray 20, and this length L1 can be obtained by an amount of rotation of the conveyor roller 60 from the sense of the leading edge of the recording sheet 12 conveyed in the conveying direction 15 by the sensor 160 to the sense of the trailing edge of the recording sheet 12 by the sensor 160. It is noted that a method of recognizing the length L1 by the microcomputer 130 is not limited to the above-described method using the sense of the sensor 160 and the rotational amount of the conveyor roller 60. For example, the microcomputer 130 may recognize the length L1 based on a size of the recording sheet 12 which is set by the user having operated the operation panel 17 before printing.

The length L2 is a length of a conveyance path extending from a position at which the reversible roller pair 43 nips the recording sheet 12, through the first connecting position 36, the second conveyance path 67, the second connecting position 37, and the first conveyance path 65 to the position at which the reversible roller pair 43 nips the recording sheet 12. The length L2 is a design value that is determined, for example, by a length of the first conveyance path 65 and the second conveyance path 67 in the MFP 10, positions of the first connecting position 36 and the second connecting position 37, and the position of the reversible roller pair 43.

Figure 13A:
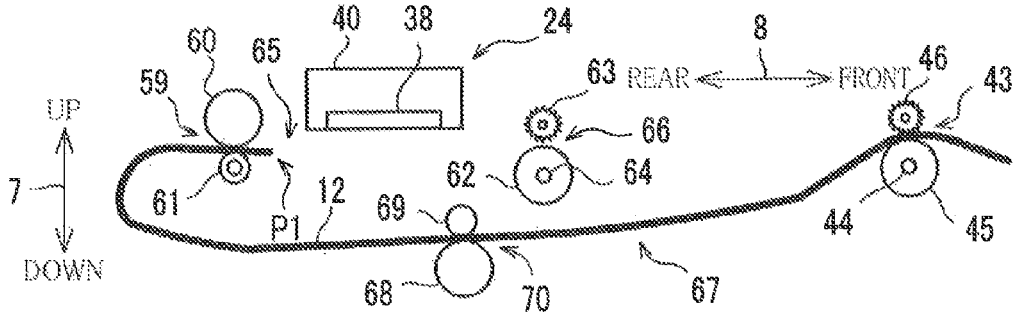
FIG. 13A-13D are elevational views in vertical cross section each schematically illustrating a part of an internal structure of the printing section 11 and the recording sheet 12 conveyed.

When the length L1 of the recording sheet 12 is longer than the length L2 of the conveyance path (S140: Yes), the microcomputer 130 determines a current position of the leading edge of the recording sheet 12 conveyed in the conveying direction 15, based on the rotational amount of the conveyor roller 60 after the sense of the leading edge of the recording sheet 12 by the sensor 160. When the current position is a predetermined position P1 (S150: Yes), the microcomputer 130 at S160 controls the state switching mechanism 140 to switch the reversible roller pair 43 from the first state to the second state (see FIG. 13A).

Here, the predetermined position P1 in the present embodiment is a position between the printing start position and a position at which the conveyor roller pair 59 nips the recording sheet 12 in the first conveyance path 65. This predetermined position P1 may be the printing start position on condition that the leading edge of the recording sheet 12 conveyed is located at the printing start position, but ink droplets have not been ejected from the nozzles onto the recording sheet 12, that is, image recording for the recording sheet 12 has not been performed yet.

In view of the above, based on the position of the recording sheet 12 recognized by the signals supplied from the sensor 160 and the rotary encoder 73, the microcomputer 130 at S160 controls the state switching mechanism 140 to switch the reversible roller pair 43 from the first state to the second state after the image recording (S80) on the first surface of the recording sheet 12 by the recording unit 24 is finished, and the recording sheet 12 is conveyed to the second conveyance path 67 by the reversible roller pair 43, and the leading edge of the recording sheet 12 is located downstream of the conveyor roller pair 59 in the conveying direction 15 and upstream of the reversible roller pair 43 in the conveying direction 15, and before image recording is started by the recording unit 24 (S150: Yes) on the second surface of the recording sheet 12.

As in the processing for recording the image on the first surface, the microcomputer 130 at S170 executes the processing for conveying the recording sheet 12 to the printing start position and at S180 controls the recording head 38 to record an image on the second surface of the recording sheet 12. It is noted that in the case where the predetermined position is the printing start position, the image recording is performed at S180 on the second surface of the recording sheet 12 without conveying of the recording sheet 12 after the switching of the reversible roller pair 43.

Upon completion of the image recording on the second surface of the recording sheet 12, the microcomputer 130 at S190 controls the state switching mechanism 140 to switch the reversible roller pair 43 from the second state to the first state.

When the length L1 is shorter than the length L2 (S140: No), the microcomputer 130 at S200 executes the processing for conveying the recording sheet 12 to the printing start position without switching the state of the reversible roller pair 43 and at S210 controls the recording head 38 to record an image on the second surface of the recording sheet 12.

In view of the above, the microcomputer 130 controls the state switching mechanism 140 to switch the reversible roller pair 43 from the first state to the second state on the condition that the length L1 is longer than the length L2.

After the processing at S190 or S210, the microcomputer 130 rotates the conveyor motor 71 in the forward direction to rotate the conveyor roller 60, the output roller 62, and the reversible rollers 45 in the second rotational direction to convey the recording sheet 12 in the conveying direction 15, so that the recording sheet 12 is discharged onto the output tray 21 at S220.

<Effects>

In the present embodiment, the reversible roller pair 43 is switched from the first state to the second state before the image recording is started for the second surface of the recording sheet 12. This operation can prevent deterioration of image quality on the recording sheet 12, which deterioration is caused by the state switch of the reversible roller pair 43 from the first state to the second state during the image recording.

In the present embodiment, the reversible roller pair 43 is switched from the first state to the second state in the state in which the leading edge of the recording sheet 12 conveyed is located downstream of the conveyor roller pair 59 in the conveying direction 15, in other words, in the state in which the recording sheet 12 is nipped by the conveyor roller pair 59. In this state, the recording sheet 12 is nipped by the conveyor roller pair 59 between the nipping position of the reversible roller pair 43 and the leading edge of the recording sheet 12. Thus, even if the state of the reversible roller pair 43 is switched in the state in which the recording sheet 12 is nipped by both of the reversible roller pair 43 and the conveyor roller pair 59, and thereby a force for moving the recording sheet 12 toward its leading edge is applied to the recording sheet 12 conveyed from the nipping position of the reversible roller pair 43, transfer of the force is hindered at the nipping position of the conveyor roller pair 59. This makes it possible to prevent unexpected movement of the recording sheet 12 due to the state switch of the reversible roller pair 43.

In the present embodiment, the sensor 160 and the rotary encoder 73 can accurately recognize the position of the recording sheet 12 in the conveying direction 15.

When the length L1 of the recording sheet 12 along the conveyance path is shorter than the length L2 of the conveyance path, a problem does not arise in which the reversible roller pair 43 fails to nip the leading edge of the recording sheet 12 conveyed, causing the recording sheet 12 to be stuck in the MFP 10. In the present embodiment, accordingly, the microcomputer 130 controls the state switching mechanism 140 to switch the reversible roller pair 43 from the first state to the second state only in a case where the problem may arise, that is, only in the case where the length L1 of the recording sheet 12 along the conveyance path is longer than the length L2 of the conveyance path. Thus, in a case where a recording sheet 12 of a small size is conveyed, the reversible roller pair 43 is not switched to the second state. That is, in the present embodiment, since the state of the reversible roller pair 43 is not switched unnecessarily, it is possible to avoid unexpected movement of the recording sheet 12 conveyed and deterioration of image quality on the recording sheet 12.

In the present embodiment, the reversible roller pair 43 is switched from the second state to the first state after the completion of the image recording on the recording sheet 12. This operation can prevent deterioration of image quality on the recording sheet 12, which deterioration is caused by the state switch of the reversible roller pair 43 from the second state to the first state during the image recording.

Since the conveyance paths 65, 67 and the roller pairs 59, 66, 43 are arranged as described above in the present embodiment, the image can be recorded on the recording sheet 12 without overlap thereof just under the recording unit 24.

First Modification

The microcomputer 130 may control the state switching mechanism 140 to switch the reversible roller pair 43 from the first state to the second state in the following manner.

In the first modification, as indicated by broken lines in FIGS. 2 and 5, a re-conveying roller pair 70 (as one example of a second conveyor roller pair) constituted by the re-conveying roller 68 and a driven roller 69 is disposed in the second conveyance path 67. The re-conveying roller 68 receives a driving force from the conveyor motor 71 via the drive-power transmitting mechanism 50 (see FIG. 8). Having received the driving force, the re-conveying roller 68 is rotated in a direction for conveying the recording sheet 12 in a conveying direction 16 along the second conveyance path 67. Here, the conveying direction 16 is a direction directed from the first connecting position 36 to the second connecting position 37 and indicated by two-dot chain line arrow in FIG. 2. When the recording sheet 12 conveyed by the reversible roller pair 43 into the second conveyance path 67 is nipped by the re-conveying roller pair 70, the recording sheet 12 is conveyed by the re-conveying roller pair 70 in the conveying direction 16, so that the recording sheet 12 is conveyed to the conveyor roller pair 59 via the second connecting position 37.

Figure 8A:
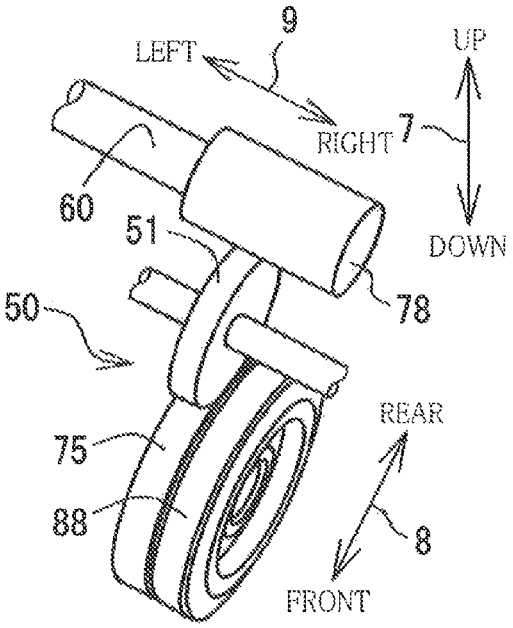
FIG. 8A is a perspective view schematically illustrating the switch gear 51 located at a first meshing position and its peripheral portion.
Figure 8B:
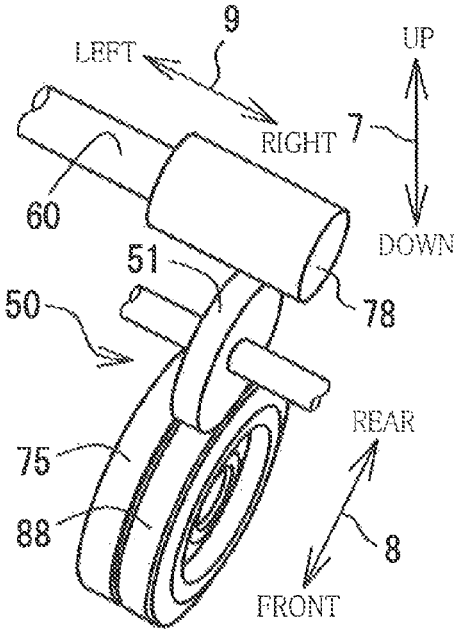
FIG. 8B is a perspective view schematically illustrating the switch gear 51 located at a second meshing position and its peripheral portion.
Figure 8C:
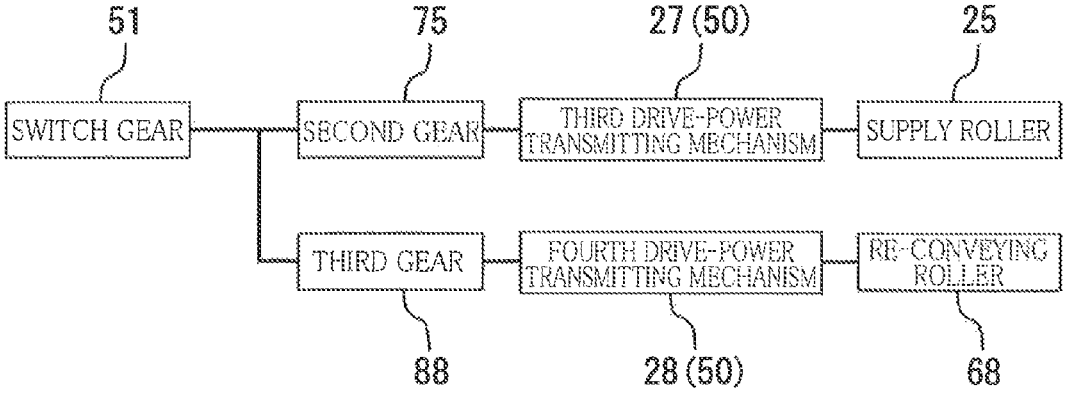
FIG. 8C is a block diagram illustrating power transmission from the switch gear 51 to a re-conveying roller 68 and the supply roller 25.

In the first modification, as illustrated in FIGS. 8A-8C, the drive-power transmitting mechanism 50 includes a fourth drive-power transmitting mechanism 28 and a third gear 88 in addition to the components provided in the above-described embodiment. The third gear 88 is disposed adjacent to the second gear 75 in the right and left direction 9 and meshable with the switch gear 51.

As illustrated in FIG. 8C, the driving force transmitted from the conveyor motor 71 to the switch gear 51 is transmitted to the re-conveying roller 68 via the third gear 88 and the fourth drive-power transmitting mechanism 28. The fourth drive-power transmitting mechanism 28 is constituted by gears and belts. For example, the fourth drive-power transmitting mechanism 28 includes a planetary gear mechanism like the third drive-power transmitting mechanism 27 and rotates the re-conveying roller 68 only in one rotational direction, specifically, in a rotational direction for conveying the recording sheet 12 in the conveying direction 16. In view of the above, the re-conveying roller 68 is rotated by the conveyor motor 71. That is, both of the supply roller 25 and the re-conveying roller 68 are rotated by the conveyor motor 71.

Figure 9:
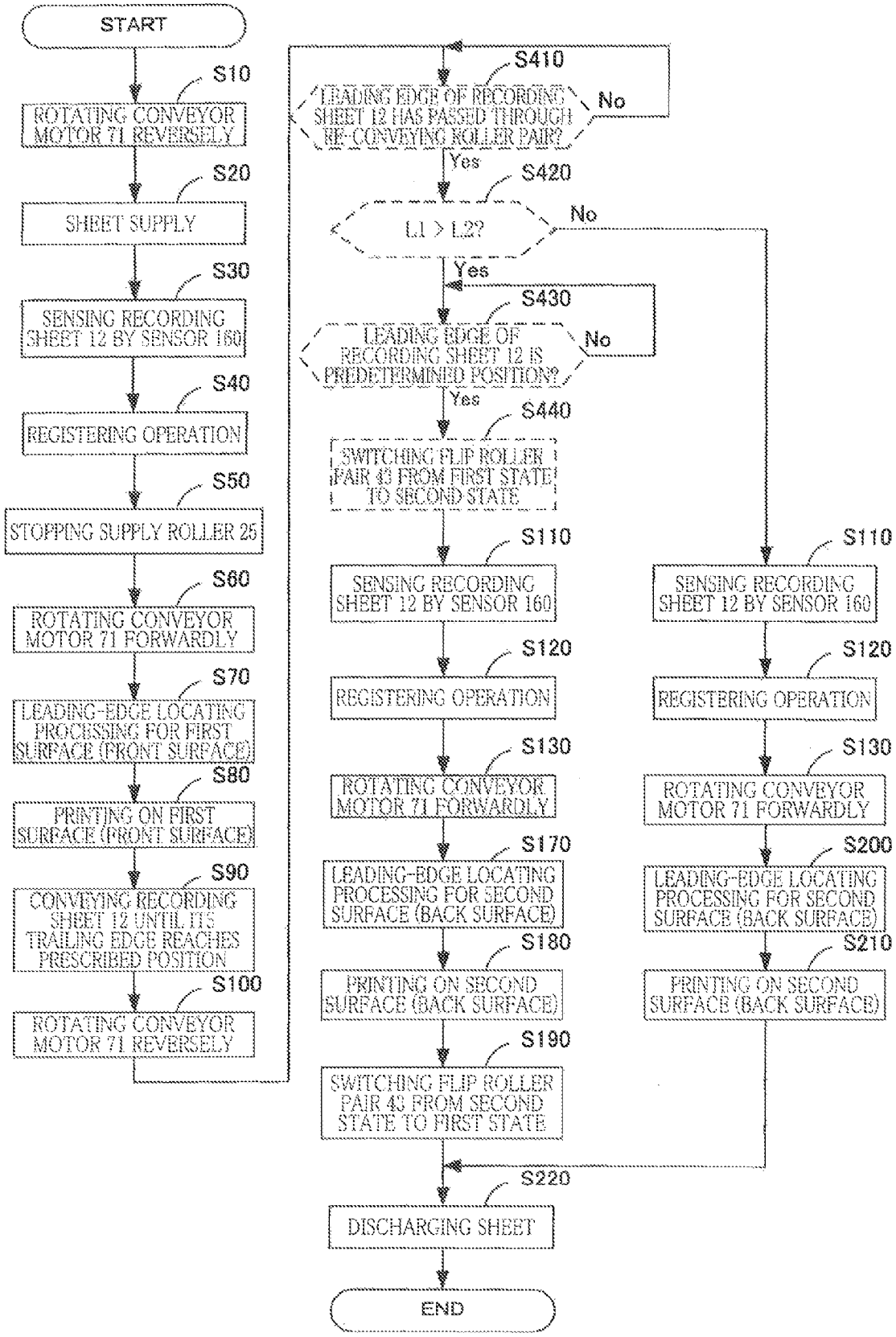
FIG. 9 is a flow chart illustrating a procedure of processings executed by the microcomputer 130 to perform duplex image recording on the recording sheet 12 in a first modification.

There will be next explained, with reference to the flow chart in FIG. 9, a procedure of processings that are executed by the microcomputer 130 to perform the duplex image recording on the recording sheet 12 in the first modification. It is noted that the switch gear 51 (see FIG. 8) in this modification is movable by an actuator dedicated to the switch gear 51 and controlled by the microcomputer 130, among a first meshing position (indicated in FIG. 8A) at which the switch gear 51 is meshed with the second gear 75, a second meshing position (indicated in FIG. 8B) at which the switch gear 51 is meshed with the third gear 88, and a neutral position, not shown, at which the switch gear 51 is not meshed with any of the second gear 75 and the third gear 88. In the following explanation, the initial position of the switch gear 51 is assumed to be the first meshing position. Also, a detailed explanation will be provided for processings (indicated by broken lines in FIG. 9) that differ from the processings in FIG. 6 in the above-described embodiment, but no or a simple explanation will be provided for processings (indicated by solid lines in FIG. 9) identical to any of the processings in FIG. 6.

In the first modification, when the trailing edge of the recording sheet 12 conveyed in the conveying direction 15 reaches the prescribed position located between the auxiliary roller 47 and the auxiliary roller 48 (S90), the path switching member 41 is switched from the discharge orientation to the reverse orientation, and then the microcomputer 130 moves the switch gear 51 from the neutral position to the second meshing position. As a result, as illustrated in FIGS. 8B and 8C, the conveyor motor 71 and the re-conveying roller 68 are coupled to each other via, e.g., the fourth drive-power transmitting mechanism 28, so that the re-conveying roller 68 can be rotated. At S100, the microcomputer 130 switches the rotation of the conveyor motor 71 from the forward rotation to the reverse rotation, so that the conveyor roller 60, the output roller 62, and the reversible rollers 45 are rotated in the first rotational direction, and the re-conveying roller 68 is also rotated.

As a result of the processing at S100, the conveying direction of the recording sheet 12 is switched to the direction reverse to the conveying direction 15, so that the upstream edge of the recording sheet 12 in the conveying direction 15 is directed to the second conveyance path 67, and the recording sheet 12 is conveyed to the second conveyance path 67. The recording sheet 12 conveyed into the second conveyance path 67 is conveyed from the first connecting position 36 to the second connecting position 37 along the second conveyance path 67.

The microcomputer 130 at S410 determines whether the leading edge of the recording sheet 12 conveyed along the second conveyance path 67 (i.e., the downstream edge of the recording sheet 12 in the conveying direction 16) has passed through the re-conveying roller pair 70 or not. When the leading edge has passed through the re-conveying roller pair 70 (S410: Yes), the microcomputer 130 at S420 determines whether the length L1 is longer than the length L2 or not as in the processing at S140 in the above-described embodiment.

Figure 13B:
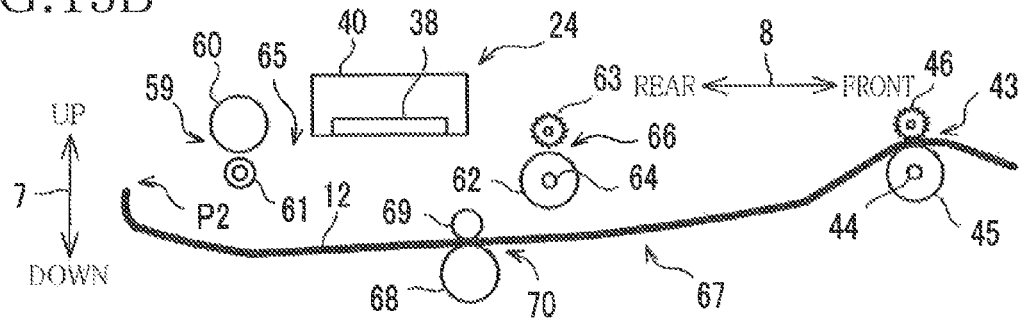

When the length L1 is longer than the length L2 (S420: Yes), the microcomputer 130 determines the current position of the leading edge of the recording sheet 12 conveyed. When the current position is a predetermined position P2 (S430: Yes), the microcomputer 130 at S440 controls the state switching mechanism 140 to switch the reversible roller pair 43 from the first state to the second state (see FIG. 13B).

Figure 7:
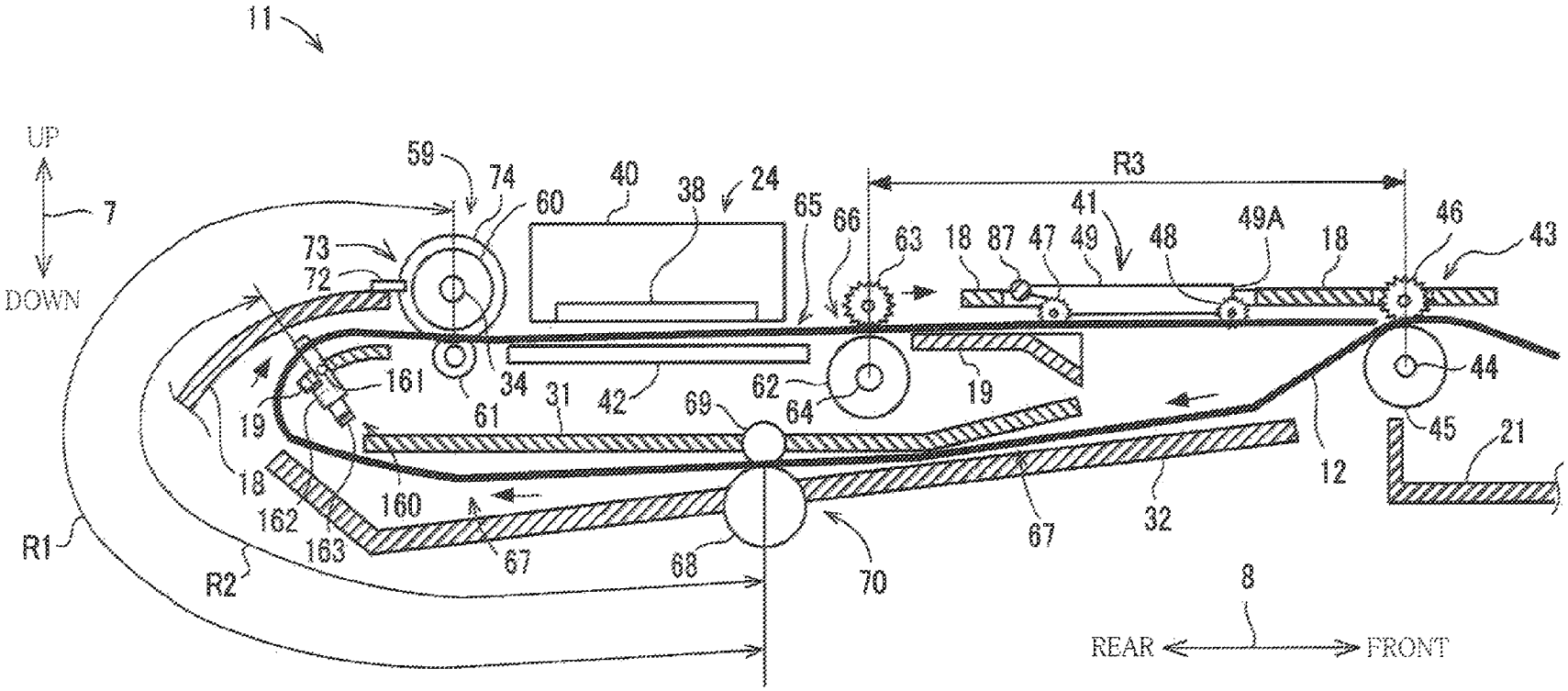
FIG. 7 is an elevational view in vertical cross section schematically illustrating a first conveyance path 65, a second conveyance path 67, and their peripheral portion.

Here, the predetermined position P2 in the first modification is located downstream of the re-conveying roller pair 70 in the conveying direction 16 and upstream of the conveyor roller pair 59 in the conveying direction 15 and located at a position within a range R1 in FIG. 7.

It is noted that a predetermined position in the first modification may be a position located downstream of the re-conveying roller pair 70 in the conveying direction 16 and upstream of the sensor 160 in the conveying direction 15, in other words, the predetermined position may be a position within a range R2 in FIG. 7. In this case, the microcomputer 130 can accurately determine whether the recording sheet 12 is brought into contact with the conveyor roller pair 59 or not in the registering operation as will be described below.

In view of the above, based on the position of the recording sheet 12 recognized by the signals supplied from the sensor 160 and the rotary encoder 73, the microcomputer 130 at S440 controls the state switching mechanism 140 to switch the reversible roller pair 43 from the first state to the second state on condition that the image recording for the first surface by the recording unit 24 (S80) is finished, and the leading edge of the recording sheet 12 conveyed into the second conveyance path 67 by the reversible roller pair 43 is located at the predetermined position that is downstream of the re-conveying roller pair 70 in the conveying direction 16 and upstream of the conveyor roller pair 59 in the conveying direction 15 (S430: Yes).

The microcomputer 130 thereafter executes processings at S110, S120, S130, S170, S180, S190, and S220 that are the same processings as in the above-described embodiment. In the first modification, when the rotational direction of the conveyor motor 71 is switched from the reverse direction to the forward direction at S130 to rotate the conveyor roller 60, the output roller 62, and the reversible rollers 45 in the second rotational direction, the re-conveying roller pair 70 and the reversible roller pair 43 both nipping the recording sheet 12 pull the recording sheet 12 to their respective sides. To solve this problem, in the first modification, the conveying force of the re-conveying roller pair 70 is set to be larger than the conveying force of the reversible roller pair 43. Here, as described above, the conveying force is a force of a roller pair for conveying the recording sheet 12 and determined, for example, by a speed of rotation, a material, and a nipping force of rollers of the roller pair. Since a force of the re-conveying roller pair 70 for conveying the recording sheet 12 is larger than that of the reversible roller pair 43 for conveying the recording sheet 12, the re-conveying roller pair 70 can pull the recording sheet 12 off from the reversible roller pair 43 to convey the recording sheet 12.

On the other hand, when the length L1 is shorter than the length L2 (S420: No), the microcomputer 130 executes processings at S110, S120, S130, S200, S210, and S220 that are the same processings as in the above-described embodiment, without switching the state of the reversible roller pair 43.

In the first modification, the reversible roller pair 43 is switched from the first state to the second state in a state in which the recording sheet 12 is nipped by the re-conveying roller pair 70 but not nipped by the conveyor roller pair 59. In this state, the recording sheet 12 is nipped by the re-conveying roller pair 70 at a position located between the nipping position of the reversible roller pair 43 and the leading edge of the recording sheet 12 being conveyed. Thus, even if the state of the reversible roller pair 43 is switched in the state in which the recording sheet 12 is nipped by both of the reversible roller pair 43 and the re-conveying roller pair 70, and thereby a force for moving the recording sheet 12 toward its leading edge is applied to the recording sheet 12 conveyed from the nipping position of the reversible roller pair 43, transfer of the force is hindered at a nipping position of the re-conveying roller pair 70. This makes it possible to prevent unexpected movement of the recording sheet 12 due to the state switch of the reversible roller pair 43, thereby avoiding skew of the recording sheet 12 due to the unexpected movement of the recording sheet 12. As a result, the registering operation can be performed more accurately.

Also, when the registering operation is performed, the microcomputer 130 needs to determine whether the leading edge of the recording sheet 12 conveyed is brought into contact with the conveyor roller pair 59 or not. Normally, this determination is executed in the following manner: the leading edge of the recording sheet 12 conveyed is sensed by the sensor 160 provided in the first conveyance path 65 at a position located upstream of the conveyor roller pair 59 in the conveying direction 15 and downstream of the second connecting position 37 in the conveying direction 15, and then the position of the leading edge of the recording sheet 12 is determined based on the rotational amount of the roller from the sensing. In this first modification, the state of the reversible roller pair 43 may be switched before the leading edge of the recording sheet 12 reaches the sensor 160. As a result, even if the recording sheet 12 is moved by the state switch of the reversible roller pair 43, the leading edge of the recording sheet 12 is accurately recognized in the above-described determination.

To perform the registering operation accurately, it is preferable that an angle of skew of the recording sheet 12 supplied by the supply roller 25 from the supply tray 20 to the first conveyance path 65 and an angle of skew of the recording sheet 12 conveyed by the re-conveying roller pair 70 from the second conveyance path 67 to the first conveyance path 65 are not different so much. In this first modification, since both of the supply roller 25 and the re-conveying roller 68 are rotated by the conveyor motor 71 as explained in the above-described embodiment, the difference in the angle of the skew between the case where the recording sheet 12 is supplied by the supply roller 25 and the case where the recording sheet 12 is conveyed by the re-conveying roller pair 70 can be kept small.

Second Modification

The microcomputer 130 may control the state switching mechanism 140 to switch the reversible roller pair 43 from the first state to the second state in the following manner.

Figure 10:
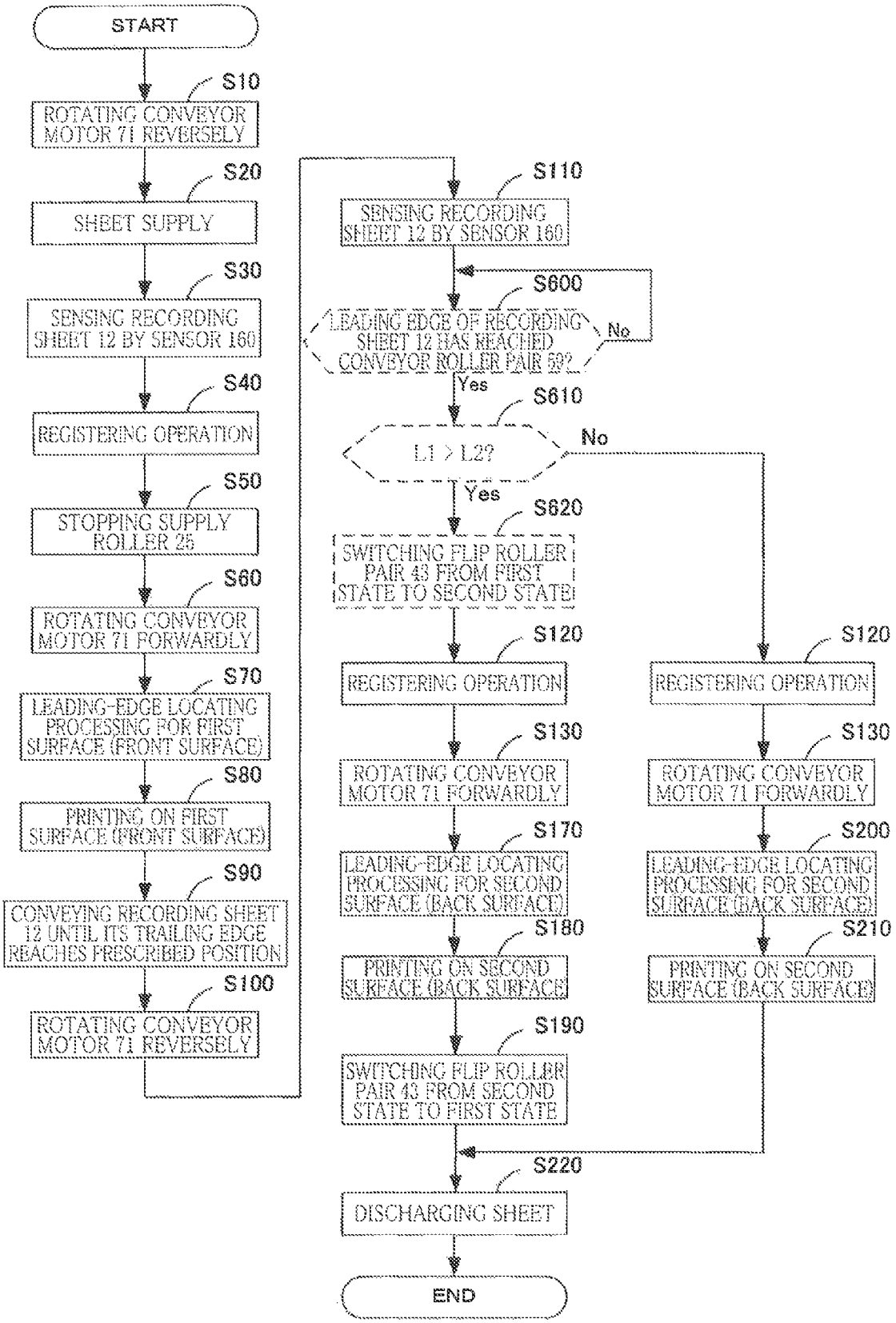
FIG. 10 is a flow chart illustrating a procedure of processings executed by the microcomputer 130 to perform duplex image recording on the recording sheet 12 in a second modification.

There will be next explained, with reference to the flow chart in FIG. 10, a procedure of processings that are executed by the microcomputer 130 to perform the duplex image recording on the recording sheet 12 in the second modification. It is noted that the switch gear 51 (see FIG. 4) in this modification is movable by an actuator dedicated to the switch gear 51 and controlled by the microcomputer 130, between the meshing position (indicated in FIG. 4B) at which the switch gear 51 is meshed with the second gear 75 and the neutral position (indicated in FIG. 4C) at which the switch gear 51 is not meshed with the second gear 75. In the following explanation, the initial position of the switch gear 51 is assumed to be the meshing position. Also, a detailed explanation will be provided for processings (indicated by broken lines in FIG. 10) that differ from the processings in FIG. 6 in the above-described embodiment, but no or a simple explanation will be provided for processings (indicated by solid lines in FIG. 10) identical to any of the processings in FIG. 6.

Figure 13C:
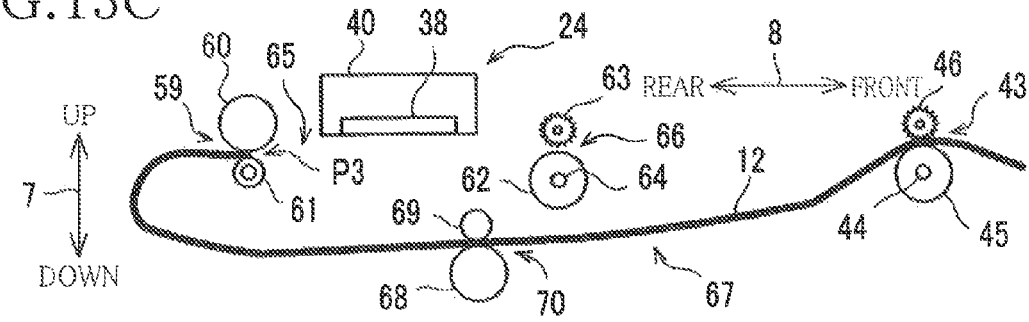

In this second modification, after the leading edge of the recording sheet 12 conveyed from the second conveyance path 67 to the first conveyance path 65 again reaches the sensor 160 (S110), the microcomputer 130 at S600 determines whether or not the leading edge has reached a nipping position P3 at which the recording sheet 12 is nipped by the conveyor roller pair 59 (see FIG. 13C). When the leading edge has reached the nipping position P3 (S600: Yes), the microcomputer 130 at S610 determines whether the length L1 is longer than the length L2 or not as in the processing at S140 in the above-described embodiment.

When the length L1 is longer than the length L2 (S610: Yes), the microcomputer 130 at S620 controls the state switching mechanism 140 to switch the reversible roller pair 43 from the first state to the second state (see FIG. 13C). The microcomputer 130 then executes processings at S120, S130, S170, S180, S190, and S220 that are the same processings as in the above-described embodiment. It is noted that the processing at S620 (i.e., the state switch of the reversible roller pair 43) only has to be executed before the processing at S130 (i.e., the switch of the rotational direction of the conveyor roller 60). Thus, the order of the processing at S620 (i.e., the state switch of the reversible roller pair 43) and the processing at S120 (i.e., the registering operation) may be interchanged.

On the other hand, when the length L1 is shorter than the length L2 (S610: No), the microcomputer 130 executes processings at S120, S130, S200, S210, and S220 that are the same processings as in the above-described embodiment, without switching the state of the reversible roller pair 43.

In view of the above, based on the position of the recording sheet 12 recognized by the signals supplied from the sensor 160 and the rotary encoder 73, the microcomputer 130 at S620 controls the state switching mechanism 140 to switch the reversible roller pair 43 from the first state to the second state after the image recording for the first surface by the recording unit 24 (S80) is finished, and the leading edge of the recording sheet 12 conveyed into the second conveyance path 67 by the reversible roller pair 43 had reached the nipping position of the conveyor roller pair 59 (S600: Yes), and before the rotational direction of the conveyor roller 60 of the conveyor roller pair 59 is switched from the first rotational direction to the second rotational direction (S130).

In this second modification, the conveyor roller 60 of the conveyor roller pair 59 and the reversible roller 45 of the reversible roller pair 43 are rotated forwardly or reversely so as to convey the recording sheet 12 in the same direction. Thus, when the reversible roller pair 43 is conveying the recording sheet 12 in the conveying direction 16, the conveyor roller pair 59 is rotated in the first rotational direction for conveying the recording sheet 12 in the direction reverse to the conveying direction 15. On the other hand, when the conveyor roller pair 59 is rotated in the second rotational direction for conveying the recording sheet 12 in the conveying direction 15, the reversible roller pair 43 is also rotated so as to convey the recording sheet 12 in the conveying direction 15. Thus, if the rotational direction of the conveyor roller pair 59 is switched from the first rotational direction to the second rotational direction in a state in which a leading edge portion of the recording sheet 12 is nipped by the conveyor roller pair 59, and a trailing edge portion of the recording sheet 12 is nipped by the reversible roller pair 43, the conveyor roller pair 59 and the reversible roller pair 43 pull the recording sheet 12 to their respective sides. To solve this problem, in this second modification, the reversible roller pair 43 is switched from the first state to the second state before the rotational direction of the conveyor roller pair 59 is switched from the first rotational direction to the second rotational direction. This operation can prevent the conveyor roller pair 59 and the reversible roller pair 43 from pulling the recording sheet 12 to their respective sides.

Third Modification

The microcomputer 130 may control the state switching mechanism 140 to switch the reversible roller pair 43 from the first state to the second state in the following manner.

In this third modification, the re-conveying roller pair 70 as indicated by broken lines in FIG. 2 is provided in the second conveyance path 67 as in the first modification. Also, as in the first modification, the drive-power transmitting mechanism 50 in the third modification includes the fourth drive-power transmitting mechanism 28 and the third gear 88 in addition to the components provided in the above-described embodiment (see FIG. 8).

Figure 11:
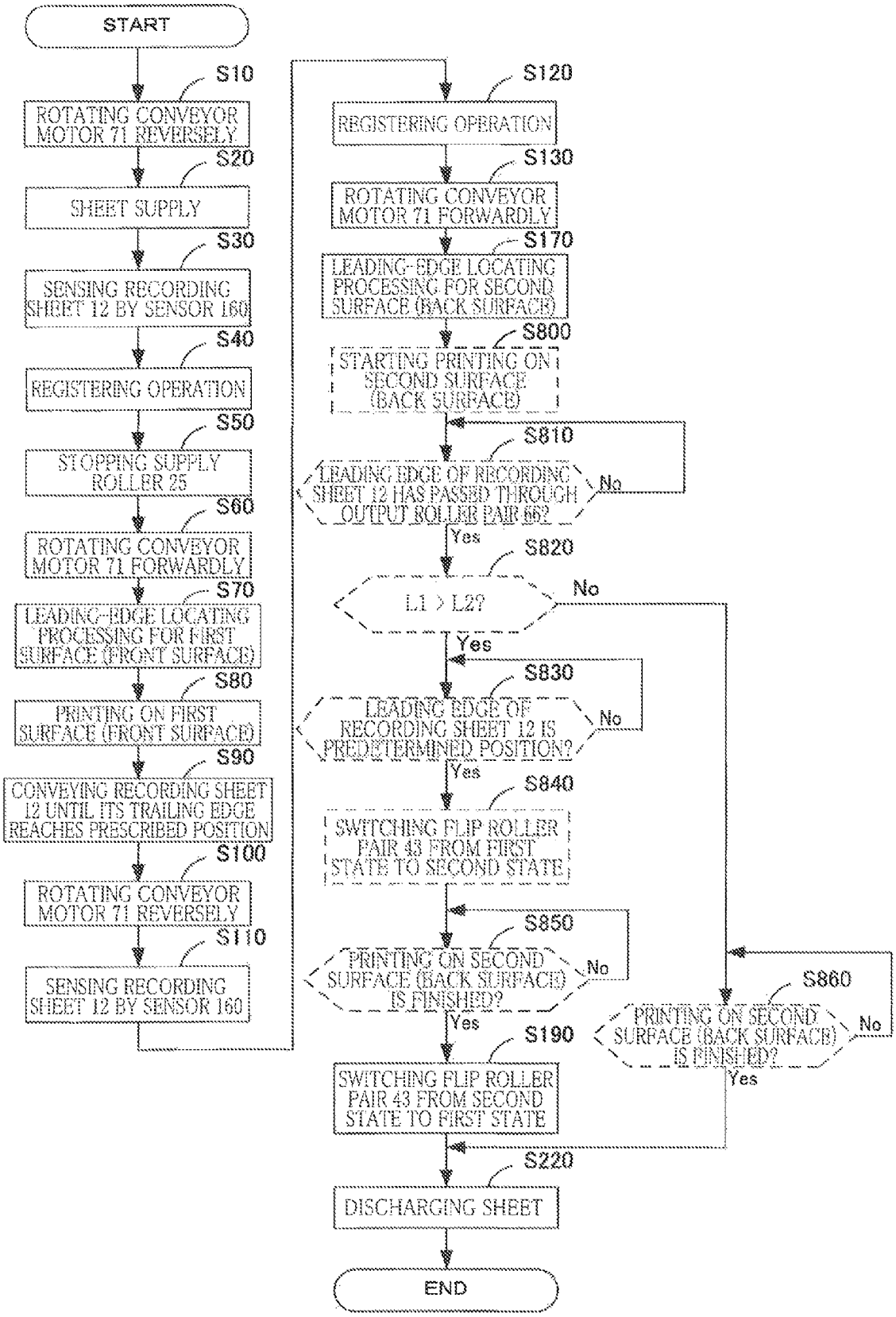
FIG. 11 is a flow chart illustrating a procedure of processings executed by the microcomputer 130 to perform duplex image recording on the recording sheet 12 in a third modification.

There will be next explained, with reference to the flow chart in FIG. 11, a procedure of processings that are executed by the microcomputer 130 to perform the duplex image recording on the recording sheet 12 in the third modification. It is noted that the switch gear 51 (see FIG. 8) in this modification is movable as in the first modification by an actuator dedicated to the switch gear 51 and controlled by the microcomputer 130, among a first meshing position (indicated in FIG. 8A) at which the switch gear 51 is meshed with the second gear 75, a second meshing position (indicated in FIG. 8B) at which the switch gear 51 is meshed with the third gear 88, and a neutral position, not shown, at which the switch gear 51 is not meshed with any of the second gear 75 and the third gear 88. In the following explanation, the initial position of the switch gear 51 is assumed to be the first meshing position. Also, a detailed explanation will be provided for processings (indicated by broken lines in FIG. 11) that differ from the processings in FIG. 6 in the above-described embodiment and the processings in FIG. 9 in the first modification, but no or a simple explanation will be provided for processings (indicated by solid lines in FIG. 11) identical to any of the processings in FIG. 6 and the processings in FIG. 9.

In this third modification, when the image recording on the second surface of the recording sheet 12 is started at S800, the microcomputer 130 at S810 determines whether the leading edge of the recording sheet 12, i.e., the downstream edge of the recording sheet 12 in the conveying direction 15 has passed through the output roller pair 66 or not. When the leading edge has passed through the output roller pair 66 (S810: Yes), the microcomputer 130 at S820 determines whether the length L1 is longer than the length L2 or not as in the processing at S140 in the above-described embodiment.

Figure 13D:
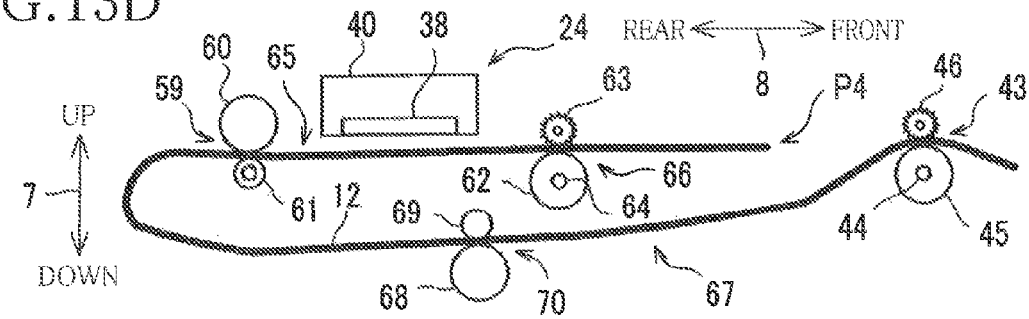

When the length L1 is longer than the length L2 (S820: Yes), the microcomputer 130 determines the current position of the leading edge of the recording sheet 12 conveyed. When the current position is a predetermined position P4 (S830: Yes), the microcomputer 130 at S840 controls the state switching mechanism 140 to switch the reversible roller pair 43 from the first state to the second state (see FIG. 13D).

Here, the predetermined position P4 in the third modification is located downstream of the output roller pair 66 in the conveying direction 16 and upstream of the reversible roller pair 43 in the conveying direction 15 and located at a position within a range R3 in FIG. 7.

It is noted that the processing at S840 (i.e., the state switch of the reversible roller pair 43) is executed when ink droplets are not ejected in the image recording processing for the second surface of the recording sheet 12, for example, when the recording sheet 12 is being conveyed by the predetermined linefeed distance.

Upon completion of the image recording on the second surface of the recording sheet 12 (S850: Yes), the microcomputer 130 at S190 controls the state switching mechanism 140 to switch the reversible roller pair 43 from the second state to the first state. The microcomputer 130 at S220 executes the processing for discharging the recording sheet 12 onto the output tray 21.

In view of the above, based on the position of the recording sheet 12 recognized by the signals supplied from the sensor 160 and the rotary encoder 73, the microcomputer 130 at S840 controls the state switching mechanism 140 to switch the reversible roller pair 43 from the first state to the second state on condition that the image recording for the first surface by the recording unit 24 (S80) is finished, and the leading edge of the recording sheet 12 conveyed by the reversible roller pair 43 into the second conveyance path 67 and being printed on the second surface (S800) is located at the predetermined position that is downstream of the output roller pair 66 in the conveying direction 15 and upstream of the reversible roller pair 43 in the conveying direction 15 (S830: Yes).

On the other hand, when the length L1 is shorter than the length L2 (S820: No), the microcomputer 130 does not execute the processings at S830, S840, and S190. Upon completion of the image recording on the second surface of the recording sheet 12 (S860: Yes), the microcomputer 130 at S220 executes the processing for discharging the recording sheet 12 onto the output tray 21.

In this third modification, when the reversible roller pair 43 is switched from the first state to the second state, the recording sheet 12 is nipped by the conveyor roller pair 59 and the output roller pair 66 respectively on upstream and downstream sides of the recording unit 24. This state can reduce movement of the recording sheet 12 due to the state switch of the reversible roller pair 43, at a position on the recording sheet 12 which is opposed to the recording unit 24, i.e., a position on the recording sheet 12 where the image recording is performed. As a result, it is possible to prevent deterioration of image quality on the recording sheet 12 due to the movement of the recording sheet 12.

Fourth Modification

As in the first modification and the third modification, the re-conveying roller pair 70 may be provided in the second conveyance path 67 in the above-described embodiment and the second modification.

In a case where the re-conveying roller pair 70 is provided in the second conveyance path 67 in the above-described embodiment, even if the state of the reversible roller pair 43 is switched, and thereby a force for moving the recording sheet 12 toward its leading edge is applied to the recording sheet 12 conveyed from the nipping position of the reversible roller pair 43, the recording sheet 12 is nipped by both of the conveyor roller pair 59 and the re-conveying roller pair 70. This makes it possible to prevent unexpected movement of the recording sheet 12 due to the state switch of the reversible roller pair 43, more reliably than in the above-described embodiment.

In a case where the re-conveying roller pair 70 is provided in the second conveyance path 67 in the second modification, even if the state of the reversible roller pair 43 is switched, and thereby a force for moving the recording sheet 12 toward its leading edge is applied to the recording sheet 12 conveyed from the nipping position of the reversible roller pair 43, the recording sheet 12 is nipped by the output roller pair 66, the conveyor roller pair 59, and the re-conveying roller pair 70. This makes it possible to prevent unexpected movement of the recording sheet 12 due to the state switch of the reversible roller pair 43, more reliably than in the third modification.

<Fifth Modification>

In the above-described embodiment, upon completion of the image recording on the second surface of the recording sheet 12, the microcomputer 130 at S190 controls the state switching mechanism 140 to switch the reversible roller pair 43 from the second state to the first state. However, the reversible roller pair 43 may be switched from the second state to the first state at a timing that differs from the timing of the completion of the image recording on the second surface of the recording sheet 12.

In the fifth modification, the microcomputer 130 controls the state switching mechanism 140 to switch the reversible roller pair 43 from the second state to the first state when the trailing edge of the recording sheet 12 conveyed by the reversible roller pair 43 along the second conveyance path 67 has come out of the nipping position of the reversible roller pair 43, that is, when the railing edge has passed through the reversible roller pair 43.

In the fifth modification, when the reversible roller pair 43 is switched from the second state to the first state, the recording sheet 12 is not nipped by the reversible roller pair 43, preventing the conveyor roller pair 59 and the reversible roller pair 43 from pulling the recording sheet 12 to their respective sides.

Sixth Modification

The reversible roller pair 43 may be switched from the second state to the first state at a timing that differs from those in the above-described embodiment and the fifth modification.

In the sixth modification, the microcomputer 130 controls the state switching mechanism 140 to switch the reversible roller pair 43 from the second state to the first state when the leading edge of the recording sheet 12 has passed through the nipping position of the reversible roller pair 43 during the image recording on the second surface of the recording sheet 12. It should be understood that the state of the reversible roller pair 43 is switched not at a timing of the reciprocation of the carriage 40, the ink ejection of the recording head 38, or the conveyance of the recording sheet 12 by the predetermined linefeed distance but at a timing after the ink ejection and before the conveyance of the recording sheet 12 by the predetermined linefeed distance or a timing after the conveyance of the recording sheet 12 by the predetermined linefeed distance and before the ink ejection.

In the sixth modification, when ink droplets are ejected onto the recording sheet 12, the reversible roller pair 43 is not switched from the second state to the first state, thereby reducing the movement of the recording sheet 12 due to the state switch of the reversible roller pair 43. As a result, it is possible to prevent deterioration of image quality on the recording sheet 12 due to the movement of the recording sheet 12.

Seventh Modification

As illustrated in FIG. 2, the second conveyance path 67 in the above-described embodiment branches off from the first connecting position 36 located downstream of the output roller pair 66 in the conveying direction 15 and upstream of the reversible roller pair 43 in the conveying direction 15, and merges with the first conveyance path 65 at the second connecting position 37 located upstream of the conveyor roller pair 59 in the conveying direction 15. However, the second conveyance path 67 is not limited to having this construction as long as the recording sheet 12 is turned upside down.

Figure 14A:
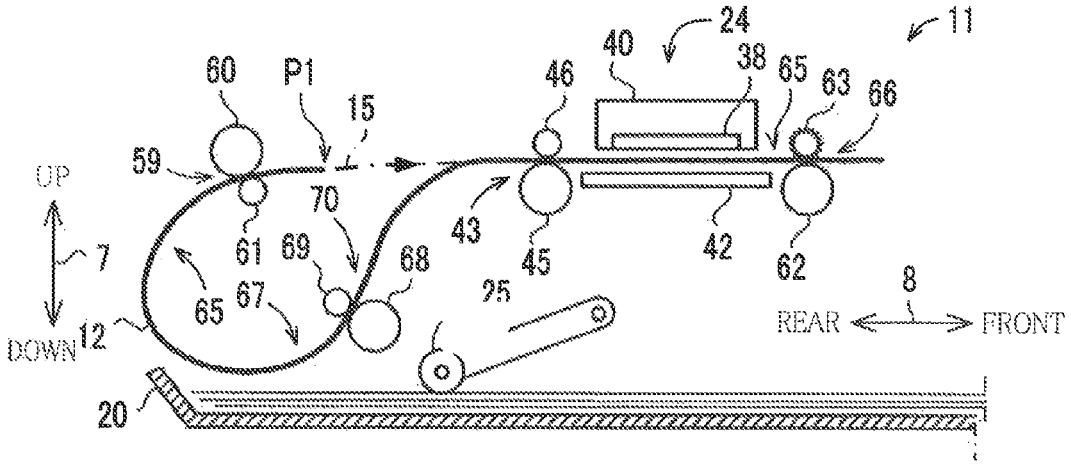
FIGS. 14A-14C are elevational views in vertical cross section schematically illustrating an internal structure of the printing section 11 in a seventh modification.
Figure 14B:
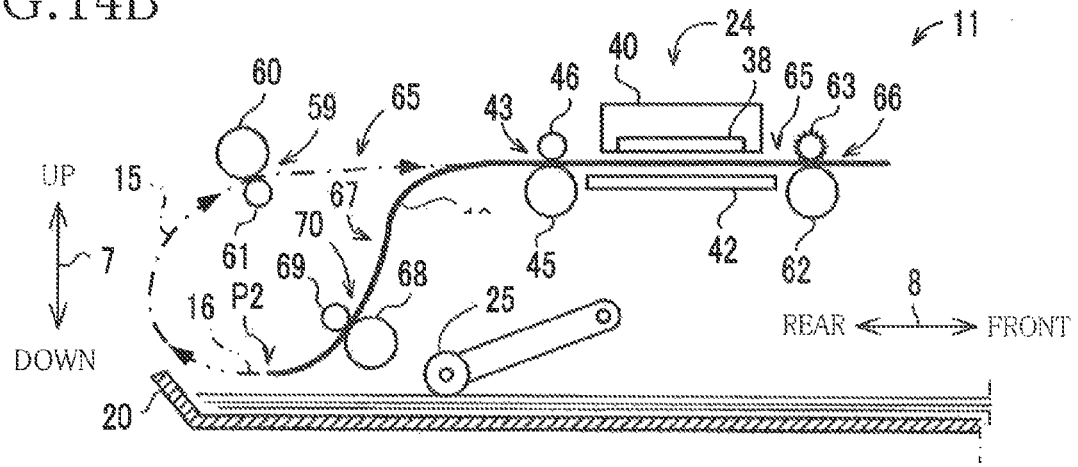
Figure 14C:
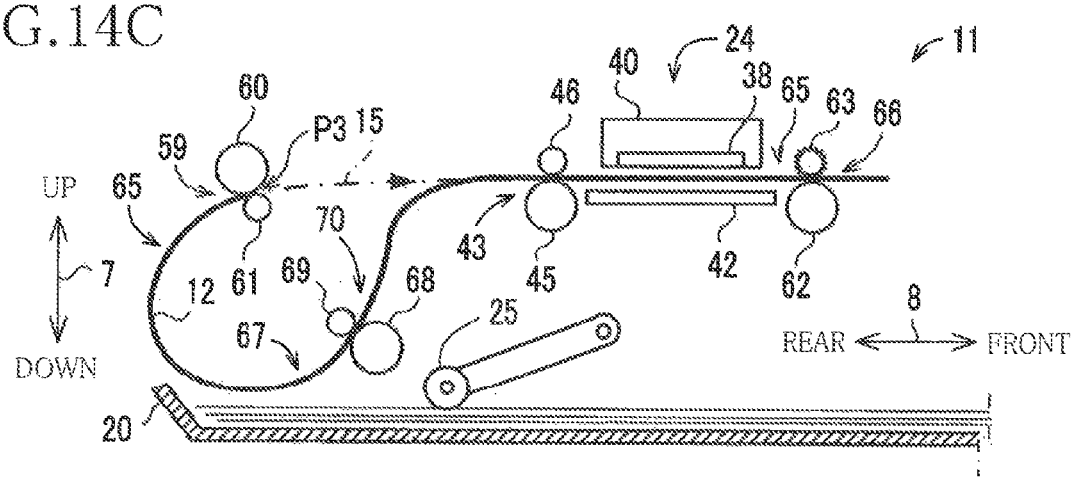

For example, as illustrated in FIGS. 14A-14C, the MFP 10 may be configured such that the reversible roller pair 43 is disposed in the first conveyance path 65 at a position between the conveyor roller pair 59 and the recording unit 24 and such that the second conveyance path 67 is connected to the first conveyance path 65 at a position that is downstream of the conveyor roller pair 59 in the conveying direction 15 and upstream of the reversible roller pair 43 in the conveying direction 15 and at a position that is upstream of the conveyor roller pair 59 in the conveying direction 15. It is noted that FIG. 14 does not illustrate the path switching member 41 provided between the conveyor roller pair 59 and the reversible roller pair 43 on an upper side of the first conveyance path 65.

Also, in the example in FIGS. 14A-14C, the recording sheet 12 placed on the supply tray 20 is conveyed to the reversible roller pair 43 via the conveyor roller pair 59 and thereafter conveyed by the reversible roller pair 43 to a position under the recording unit 24 where the recording unit 24 records an image of the first surface of the recording sheet 12. In a case of simplex image recording, the recording sheet 12 is discharged by the output roller pair 66. In the case of duplex image recording, on the other hand, the recording sheet 12 is conveyed by the output roller pair 66 back to the reversible roller pair 43 via the position under the recording unit 24. The recording sheet 12 is then conveyed by the reversible roller pair 43 to the second conveyance path 67 and conveyed in the conveying direction 16 indicated by two-dot chain line arrow in FIG. 14B. When the leading edge of the recording sheet 12 has reached the conveyor roller pair 59, the recording sheet 12 is conveyed in the conveying direction 15 by the conveyor roller pair 59. At this time, the rotational direction of the reversible roller pair 43 is switched to the direction for conveying the recording sheet 12 in the conveying direction 15. Owing to these operations, the conveyor roller pair 59 and the reversible roller pair 43 pull the recording sheet 12 to their respective sides, but the driving force of the conveyor roller pair 59 is larger than that of the reversible roller pair 43, so that the recording sheet 12 can be conveyed in the conveying direction 15. Thus, the recording sheet 12 is conveyed to the reversible roller pair 43 again while being reversed or turned upside down. The recording sheet 12 is then conveyed by the reversible roller pair 43 to the position under the recording unit 24 where the recording unit 24 records an image of the second surface of the recording sheet 12. The recording sheet 12 is thereafter discharged onto the output roller pair 66.

In this modification, the position P1 (see FIG. 13A), the position P2 (see FIG. 13B), and the position P3 (see FIG. 13C) in the above-described embodiment and the modifications respectively correspond to a position P1 illustrated in FIG. 14A, a position P2 illustrated in FIG. 14B, and a position P3 illustrated in FIG. 14C.

Eighth Modification

While the reversible roller pair 43 is switched from the second state to the first state at the timing after the ink ejection and before the conveyance of the recording sheet 12 by the predetermined linefeed distance or the timing after the conveyance of the recording sheet 12 by the predetermined linefeed distance and before the ink ejection in the sixth modification, the reversible roller pair 43 may be switched from the first state to the second state at one of these timings. For example, in the case where the reversible roller pair 43 is switched from the first state to the second state with the recording sheet 12 located just under the recording unit 24 as in the third modification, the reversible roller pair 43 may be switched from the first state to the second state at the timing after the ink ejection and before the conveyance of the recording sheet 12 by the predetermined linefeed distance or at the timing after the conveyance of the recording sheet 12 by the predetermined linefeed distance and before the ink ejection.

In this modification, the reversible roller pair 43 is not switched from the first state to the second state during ink ejection onto the recording sheet 12, thereby reducing the movement of the recording sheet 12 due to the state switch of the reversible roller pair 43. As a result, it is possible to prevent deterioration of image quality on the recording sheet 12 due to the movement of the recording sheet 12.

Ninth Modification

In the above-described embodiment, upon completion of the image recording on the second surface of the recording sheet 12, the microcomputer 130 at S190 controls the state switching mechanism 140 to switch the reversible roller pair 43 from the second state to the first state. However, the reversible roller pair 43 may be switched from the second state to the first state at a timing that differs from the timing of the completion of the image recording on the second surface of the recording sheet 12.

In the ninth modification, when the leading edge of the recording sheet 12 conveyed by the reversible roller pair 43 to the second conveyance path 67 has reached the nipping position of the reversible roller pair 43, that is, the leading edge has passed through the reversible roller pair 43, the microcomputer 130 controls the state switching mechanism 140 to switch the reversible roller pair 43 from the second state to the first state.

In the ninth modification, when the reversible roller pair 43 is switched from the second state to the first state, the leading edge of the recording sheet 12 is nipped by the reversible roller pair 43, so that the recording sheet 12 can be appropriately conveyed by the reversible roller pair 43. Also, the recording sheet 12 is nipped by two roller pairs, namely, the conveyor roller pair 59 and the reversible roller pair 43, resulting in smooth conveyance of the recording sheet 12.

What is claimed is:

1. An image recording apparatus, comprising:

a first conveyor roller pair provided in a first conveyance path and configured to convey a sheet in a conveying direction;

a recording device provided downstream of the first conveyor roller pair in the conveying direction and configured to record an image on the sheet;

a reversible roller pair provided downstream of the first conveyor roller pair in the conveying direction and comprising a first roller and a second roller, the reversible roller pair being configured to convey the sheet in the conveying direction and configured to convey the sheet to a second conveyance path that is connected to the first conveyance path at (i) a position located downstream of the first conveyor roller pair in the conveying direction and upstream of the reversible roller pair in the conveying direction and (ii) a position located upstream of the first conveyor roller pair in the conveying direction;

a state switching mechanism configured to switch a state of the reversible roller pair between (a) a first state in which the first roller is pressed against the second roller and (b) a second state that is one of a state in which a force for pressing the first roller against the second roller is less than a force for pressing the first roller against the second roller in the first state and a state in which the first roller is spaced apart from the second roller; and a controller configured to control the reversible roller pair to convey the sheet along the second conveyance path until a leading edge of the sheet reaches a position located downstream of the first conveyor roller pair in the conveying direction and upstream of the reversible roller pair in the conveying direction in the first conveyance path, thereafter control the state switching mechanism to switch the state of the reversible roller pair from the first state to the second state, and thereafter control the recording device to perform image recording on the sheet.

2. The image recording apparatus according to claim 1, further comprising a second conveyor roller pair disposed in the second conveyance path and configured to convey the sheet toward the first conveyor roller pair.

3. The image recording apparatus according to claim 1, wherein the reversible roller pair is provided downstream of the recording device in the conveying direction, and wherein the second conveyance path is connected to the first conveyance path at (i) a position located downstream of the recording device in the conveying direction and upstream of the reversible roller pair in the conveying direction and (ii) the position located upstream of the first conveyor roller pair in the conveying direction.

4. The image recording apparatus according to claim 1, wherein the controller is configured to control the state switching mechanism to switch the state of the reversible roller pair from the second state to the first state when the recording device has finished image recording on the sheet conveyed along the second conveyance path.

5. The image recording apparatus according to claim 1, wherein the controller is configured to control the state switching mechanism to switch the state of the reversible roller pair from the second state to the first state when a trailing edge of the sheet conveyed along the second conveyance path by the reversible roller pair has passed through the reversible roller pair.

6. The image recording apparatus according to claim 1, wherein the controller is configured to control the state switching mechanism to switch the state of the reversible roller pair from the second state to the first state when the leading edge of the sheet conveyed along the second conveyance path by the reversible roller pair has passed the reversible roller pair.

7. The image recording apparatus according to claim 1, wherein the recording device is configured to eject ink droplets to record an image on the sheet, and wherein the controller is configured to alternately execute a conveyance processing in which the first conveyor roller pair conveys the sheet by a linefeed distance and a recording processing in which the recording device ejects ink droplets onto the sheet and configured to control the state switching mechanism to switch the state of the reversible roller pair from the second state to the first state within a period between the conveyance processing and the recording processing.

8. An image recording apparatus, comprising:

a first conveyor roller pair provided in a first conveyance path and configured to convey a sheet in a conveying direction;

a recording device provided downstream of the first conveyor roller pair in the conveying direction and configured to record an image on the sheet;

a reversible roller pair provided downstream of the first conveyor roller pair in the conveying direction and comprising a first roller and a second roller, the reversible roller pair being configured to convey the sheet in the conveying direction and configured to convey the sheet to a second conveyance path that is connected to the first conveyance path at (i) a position located downstream of the first conveyor roller pair in the conveying direction and upstream of the reversible roller pair in the conveying direction and (ii) a position located upstream of the first conveyor roller pair in the conveying direction;

a second conveyor roller pair disposed in the second conveyance path and configured to convey the sheet toward the first conveyor roller pair;

a state switching mechanism configured to switch a state of the reversible roller pair between (a) a first state in which the first roller is pressed against the second roller and (b) a second state that is one of a state in which a force for pressing the first roller against the second roller is less than a force for pressing the first roller against the second roller in the first state and a state in which the first roller is spaced apart from the second roller; and a controller configured to control the reversible roller pair to convey the sheet along the second conveyance path until a leading edge of the sheet reaches a first position located downstream of the second conveyor roller pair in the conveying direction and upstream of the first conveyor roller pair in the conveying direction, and thereafter control the state switching mechanism to switch the state of the reversible roller pair from the first state to the second state.

9. The image recording apparatus according to claim 8, further comprising:

a sheet sensor disposed in the first conveyance path at a position located upstream of the first conveyor roller pair in the conveying direction and downstream, in the conveying direction, of a position at which the second conveyance path is connected to the first conveyance path, the sheet sensor being configured to sense an upstream edge and a downstream edge of the sheet in the conveying direction; and a rotational amount sensor configured to sense an amount of rotation of at least one roller of the first conveyor roller pair, wherein the controller is configured to determine a position of the sheet in the conveying direction based on a result of the sensing of the sheet sensor and the rotational amount sensor, and wherein the first position is located downstream of the second conveyor roller pair in the conveying direction and upstream of the sheet sensor in the conveying direction.

10. The image recording apparatus according to claim 8, further comprising:

a tray capable of supporting the sheet; and a supply roller rotatable to supply the sheet from the tray to the first conveyance path, wherein the supply roller and at least one roller of the second conveyor roller pair are driven by one common drive motor.

11. The image recording apparatus according to claim 8, wherein the reversible roller pair is provided in the first conveyance path at a position located downstream of the recording device in the conveying direction, and wherein the second conveyance path is connected to the first conveyance path at (i) a position located downstream of the recording device in the conveying direction and upstream of the reversible roller pair in the conveying direction and (ii) the position located upstream of the first conveyor roller pair in the conveying direction.

12. The image recording apparatus according to claim 8, wherein the controller is configured to control the state switching mechanism to switch the state of the reversible roller pair from the second state to the first state when the recording device has finished image recording on the sheet conveyed along the second conveyance path.

13. The image recording apparatus according to claim 8, wherein the controller is configured to control the state switching mechanism to switch the state of the reversible roller pair from the second state to the first state when a trailing edge of the sheet conveyed along the second conveyance path by the reversible roller pair has passed through the reversible roller pair.

14. The image recording apparatus according to claim 8, wherein the controller is configured to control the state switching mechanism to switch the state of the reversible roller pair from the second state to the first state when the leading edge of the sheet conveyed along the second conveyance path by the reversible roller pair has passed the reversible roller pair.

15. The image recording apparatus according to claim 8, wherein the recording device is configured to eject ink droplets to record an image on the sheet, and wherein the controller is configured to alternately execute a conveyance processing in which the first conveyor roller pair conveys the sheet by a linefeed distance and a recording processing in which the recording device ejects ink droplets onto the sheet and configured to control the state switching mechanism to switch the state of the reversible roller pair from the second state to the first state within a period between the conveyance processing and the recording processing.

16. An image recording apparatus, comprising:

a first conveyor roller pair provided in a first conveyance path and configured to convey a sheet in a conveying direction;

a recording device provided downstream of the first conveyor roller pair in the conveying direction and configured to record an image on the sheet;

a reversible roller pair provided downstream of the first conveyor roller pair in the conveying direction and comprising a first roller and a second roller, the reversible roller pair being configured to convey the sheet in the conveying direction and configured to convey the sheet to a second conveyance path that is connected to the first conveyance path at (i) a position located downstream of the first conveyor roller pair in the conveying direction and upstream of the reversible roller pair in the conveying direction and (ii) a position located upstream of the first conveyor roller pair in the conveying direction;

a state switching mechanism configured to switch a state of the reversible roller pair between (a) a first state in which the first roller is pressed against the second roller and (b) a second state that is one of a state in which a force for pressing the first roller against the second roller is less than a force for pressing the first roller against the second roller in the first state and a state in which the first roller is spaced apart from the second roller;

a drive motor configured to produce a drive force for rotating at least one roller of the first conveyor roller pair;

a power transmission configured to transmit the drive force of the drive motor to at least one roller of the reversible roller pair such that, when the at least one roller of the first conveyor roller pair is rotated in a rotational direction for conveying the sheet in the conveying direction, the at least one roller of the reversible roller pair is rotated in the rotational direction for conveying the sheet in the conveying direction, and such that, when the at least one roller of the first conveyor roller pair is rotated in a rotational direction for conveying the sheet in a direction reverse to the conveying direction, the at least one roller of the reversible roller pair is rotated in a rotational direction for conveying the sheet to a second conveyance path; and a controller configured to control the state switching mechanism to switch the reversible roller pair from the first state to the second state after a leading edge of the sheet conveyed by the reversible roller pair along the second conveyance path reaches a position at which the first conveyor roller pair nips the sheet in the first conveyance path and before the rotational direction of the at least one roller of the first conveyor roller pair is switched from the rotational direction for conveying the sheet in the direction reverse to the conveying direction to the rotational direction for conveying the sheet in the conveying direction.

17. The image recording apparatus according to claim 16, wherein the reversible roller pair is provided in the first conveyance path at a position located downstream of the recording device in the conveying direction, and wherein the second conveyance path is connected to the first conveyance path at (i) a position located downstream of the recording device in the conveying direction and upstream of the reversible roller pair in the conveying direction and (ii) the position located upstream of the first conveyor roller pair in the conveying direction.

18. An image recording apparatus, comprising:

a first conveyor roller pair provided in a first conveyance path and configured to convey a sheet in a conveying direction;

a recording device provided downstream of the first conveyor roller pair in the conveying direction and configured to eject ink droplets to record an image on the sheet;

a reversible roller pair provided downstream of the first conveyor roller pair in the conveying direction and comprising a first roller and a second roller, the reversible roller pair being configured to convey the sheet in the conveying direction and configured to convey the sheet to a second conveyance path that is connected to the first conveyance path at (i) a position located downstream of the first conveyor roller pair in the conveying direction and upstream of the reversible roller pair in the conveying direction and (ii) a position located upstream of the first conveyor roller pair in the conveying direction;

a state switching mechanism configured to switch a state of the reversible roller pair between (a) a first state in which the first roller is pressed against the second roller and (b) a second state that is one of a state in which a force for pressing the first roller against the second roller is less than a force for pressing the first roller against the second roller in the first state and a state in which the first roller is spaced apart from the second roller; and a controller configured to alternately execute a conveyance processing in which the first conveyor roller pair conveys the sheet by a linefeed distance and a recording processing in which the recording device ejects ink droplets onto the sheet, the controller being configured to control the state switching mechanism to switch the reversible roller pair from the first state to the second state within a period for which the conveyance processing is executed or a period between the conveyance processing and the recording processing, after the controller controls the reversible roller pair to convey the sheet along the second conveyance path until a leading edge of the sheet reaches a position located downstream of the first conveyor roller pair in the conveying direction and upstream of the reversible roller pair in the conveying direction in the first conveyance path.

19. The image recording apparatus according to claim 18, wherein the reversible roller pair is provided downstream of the recording device in the conveying direction, and wherein the second conveyance path is connected to the first conveyance path at (i) a position located downstream of the recording device in the conveying direction and upstream of the reversible roller pair in the conveying direction and (ii) the position located upstream of the first conveyor roller pair in the conveying direction.

20. The image recording apparatus according to claim 19, further comprising an output roller pair disposed in the first conveyance path at a position located downstream of the recording device in the conveying direction and upstream, in the conveying direction, of a position which is downstream of the recording device and at which the first conveyance path is connected to the second conveyance path, the output roller pair being configured to convey the sheet in the conveying direction, wherein the controller is configured to control the state switching mechanism to switch the reversible roller pair from the first state to the second state after the controller controls the reversible roller pair to convey the sheet along the second conveyance path until the leading edge of the sheet reaches a position located downstream of the output roller pair in the conveying direction and upstream of the reversible roller pair in the conveying direction in the first conveyance path.

21. The image recording apparatus according to claim 18, further comprising a second conveyor roller pair disposed in the second conveyance path and configured to convey the sheet toward the first conveyor roller pair.

* * * * *